US007633000B2

(12) United States Patent
Dorfman et al.

(10) Patent No.: US 7,633,000 B2
(45) Date of Patent: Dec. 15, 2009

(54) U-JOINT FOR DOUBLE PEDAL

(75) Inventors: Michael Dorfman, Prairie View, IL (US); George Szwaya, East Troy, WI (US); Robert Szwaya, East Troy, WI (US)

(73) Assignee: Trick Percussion Products, inc., Alington Heights, IL (US)

( * ) Notice: Subject to any disclaimer, the term of this patent is extended or adjusted under 35 U.S.C. 154(b) by 113 days.

(21) Appl. No.: 11/850,112

(22) Filed: Sep. 5, 2007

(65) Prior Publication Data

US 2007/0295191 A1 Dec. 27, 2007

Related U.S. Application Data

(63) Continuation-in-part of application No. 11/217,757, filed on Sep. 1, 2005, now Pat. No. 7,456,351, which is a continuation-in-part of application No. 11/039,130, filed on Jan. 19, 2005, now Pat. No. 7,405,352.

(51) Int. Cl.
*G10D 13/02* (2006.01)

(52) U.S. Cl. ..... 84/422.1; 464/136

(58) Field of Classification Search ..... 84/422.1, 84/422.3; 464/134–136
See application file for complete search history.

(56) References Cited

U.S. PATENT DOCUMENTS 5,574,237 A 11/1996 Yanagisawa
6,137,040 A 10/2000 Hoshino
6,166,312 A 12/2000 Brewster et al.
6,570,076 B1 5/2003 Kjellgren
6,590,147 B2 7/2003 Kassabian
6,881,151 B1 4/2005 Jantz
2003/0226442 A1 12/2003 Dennis et al.
2004/0060421 A1 4/2004 Yun
2004/0144198 A1 7/2004 Gatzen
2004/0157668 A1* 8/2004 Bigelow et al. ..... 464/126

OTHER PUBLICATIONS

Stock Drive Products/Sterling Instrument, E-Product Manager website, available at https://sdp-si.com/eStore/, last viewed Sep. 11, 2007.
Stock Drive Products/Sterling Instrument, Universal Joint Product Finder, p. 7-5, available at http://www.sdp-si.com/D790/HTML2/D790C07004_2.html, last viewed Sep. 11, 2007.

(Continued)

*Primary Examiner*—Elvin G Enad
*Assistant Examiner*—Jianchun Qin
(74) *Attorney, Agent, or Firm*—Beem Patent Law Firm

(57) ABSTRACT

A drum pedal assembly for connecting a first pedal to a support holding a beater arm may include a telescoping transmission shaft having yokes attached to shaft ends, yokes having bosses, universal joints rotatably attached to bosses and using trunnions, second yokes having bosses attached to universal joints using additional trunnions. The second yokes may rotatably attach a drive assembly rotatably attached to first pedal and an attachment arbor attached to beater arm to facilitate rotation of beater arm when first pedal is depressed. Configuration of assembly, including that of universal joints, may help reduce backlash or vibration in assembly.

19 Claims, 13 Drawing Sheets

OTHER PUBLICATIONS

Pearl Drum double pedal, available at http://www.pearldrum.com/p2000-2-bc.htm & http://www.pearldrum.com/p2000-2-bc_Irg.htm. last viewed Sep. 11, 2007.

Yamaha double pedal, available at http://www.yamaha.com/drums/drumproductdetail.html?CNTID=544626&CTID=5040585&AFLG=N, last viewed Sep. 11, 2007.

Belden Universal Joints, Needle Bearing Universal Joints, available at http://www.beldenuniversal.com/pdf/Needle_Bearing_Universal_Joints.pdf, last viewed Sep. 20, 2007.

Image of Belden universal joints, received Sep. 14, 2007.

* cited by examiner

U-JOINT FOR DOUBLE PEDAL

This application is a continuation-in-part of U.S. patent application Ser. No. 11/217,757, filed on Sep. 1, 2005 now U.S. Pat. No. 7,456,351, which is a continuation-in-part of U.S. patent application Ser. No. 11/039,130, filed on Jan. 19, 2005 now U.S. Pat. No. 7,405,352.

BACKGROUND

1. Field of the Invention

This invention relates to musical instruments, more specifically, the invention is directed to a drum pedal providing an adjustable drive assembly, a cam feature and/or a clamp for connection to a drum.

2. Background of the Invention

Drummers typically use a pedal to strike a bass drum or the like. A bass drum pedal is operated by depressing a foot board and causing a beater to hit the surface of a drum. When the foot board is depressed, a drive assembly causes the beater to strike the drum. When the foot board is released, the beater returns to a ready position, ready for the next beat.

Drummers typically desire a range of adjustability in their bass drum pedals. Some drummers like their beater head to travel a larger arc than others in order to increase the range of the force at which the beater head strikes the drum. Some drummers like to have minimal foot board travel distance or minimal tension to conserve foot strength. Some drummers like to have their beaters accelerate faster during the arc in order to minimize the time between depression of the foot board and striking of the drum.

Conventional drum pedals do not allow easy adjustment of the beater head arc distance, the depression distance of the foot board, the depression tension of the foot board, or the acceleration of the beater toward the drum. Typical drum pedals lack durability to withstand rigors of use and handling.

SUMMARY OF THE INVENTION

In one embodiment of the invention, an adjustable drum pedal has a base, a foot board movable between a raised position and a depressed position, and a pedestal extending upwardly from the base. The drum pedal also has a drive assembly supported by the pedestal having a journaled drive shaft, a rotatably adjustable drive ring mounted on the drive shaft and having an arm, and a rotatably adjustable beater ring mounted on the drive shaft. A link connects the foot board with the arm. A beater has a stem affixed to the beater ring, wherein the beater is actuated to a forward position when the foot board is depressed. The foot board is biased toward a raised position and the beater is biased toward a rearward position.

In another aspect, a drum pedal has a base, a foot board, and a pedestal extending upwardly from the base. A drive assembly supported by the pedestal has a journaled drive shaft, a cam mounted on the drive shaft having a slope, a spring, and a cam follower. The cam and the spring cooperate to bias the cam follower toward a predetermined rest position. The cam follower is moved onto the slope when the foot board is depressed. The drum pedal also has a link operatively connecting the foot board to the drive shaft. The link may have a plurality of positions for adjustable connection to the foot board. A beater has a stem operatively connected to the drive shaft. The cam may also be further provided with a second slope and an indentation between the two slopes wherein the predetermined position is in the indentation.

In further aspects of the invention, the drive assembly may contain at least one bearing facilitating rotation of the drive shaft. The drive assembly may have a support ring, and the support ring may have a predetermined axial length sufficient to keep the drive shaft aligned substantially axially. The link may be adjustable in length. The spring in the drive assembly may be a compression spring. The drum pedal also may have a tension adjuster for the spring. The pedestal also may be made from aluminum casting.

In yet a further aspect, a drum pedal has a drumward end and a base has a drumward end. The drum pedal has a movable foot board, a beater operatively connects to the foot board and is actuated thereby. A clamp, operatively connected to the drumward end of the drum pedal, has a shaft, a rotatable arm operatively connectable to the shaft, and a torsion spring mounted around the shaft to bias the arm to lock with a drum rim. A lever mounted to the shaft may be rotatable to unlock the arm from the drum rim. The clamp may be operatively connected to the pedestal. The arm may have a stop for engaging the spring. The drumward end of the base may be provided with a gripping surface generally opposite the arm.

In still another aspect of the invention, biasing arm embodiment of the drum pedal may have a drive assembly supported by a pedestal having a journaled drive shaft, a rotatatable bearing mounted off center of drive shaft, a spring, a biasing arm pivotally mounted on the pedestal, wherein the bearing and the spring cooperate to bias biasing arm toward predetermined rest position, a linkage operatively connecting a foot board to the drive shaft, a beater operatively connected to the drive shaft, wherein the bearing displaces the biasing arm and compresses the spring when the foot board is depressed. A tension adjuster may form an angle between about 30 degrees and about 150 degrees with respect to the longitudinal axis of the pedestal. The beater may be actuated to a forward position when the foot board is depressed and to a rearward position when the foot board is not depressed.

In still yet a further aspect of the invention, a drum pedal may have a base having a drumward end, a moveable foot board situated above the base, a beater operatively coupled to the foot board and actuated thereby, a bracket mountable to the drumward end, and a clamp operatively connected to the bracket, the clamp having a shaft, a rotatable arm mounted to the shaft, a torsion spring mounted around the shaft and biasing the arm to lock with a drum rim, and a lever operatively connectable to the shaft and rotatable to lock and unlock the arm from the drum rim. The bracket may be adjustable along a range of positions defined by a plurality of slots in the base, each having a length of between about 0.3 inches and about 2 inches.

In another aspect of the invention, a drum pedal may have a base, a foot board, a pedestal with an axis extending upwardly from the base, a drive assembly supported by the pedestal having a journaled drive shaft, a beater operatively connected to the drive shaft, and a linkage operatively connecting the foot board to the die shaft, wherein the linkage includes an elongate link having a toe portion and a drive portion, wherein the toe portion has means for selectively defining a connection to the foot board from one of a plurality of positions. The means may include bearings having open centers for receiving a pin.

DETAILED DESCRIPTION OF THE INVENTION

Figure 1:
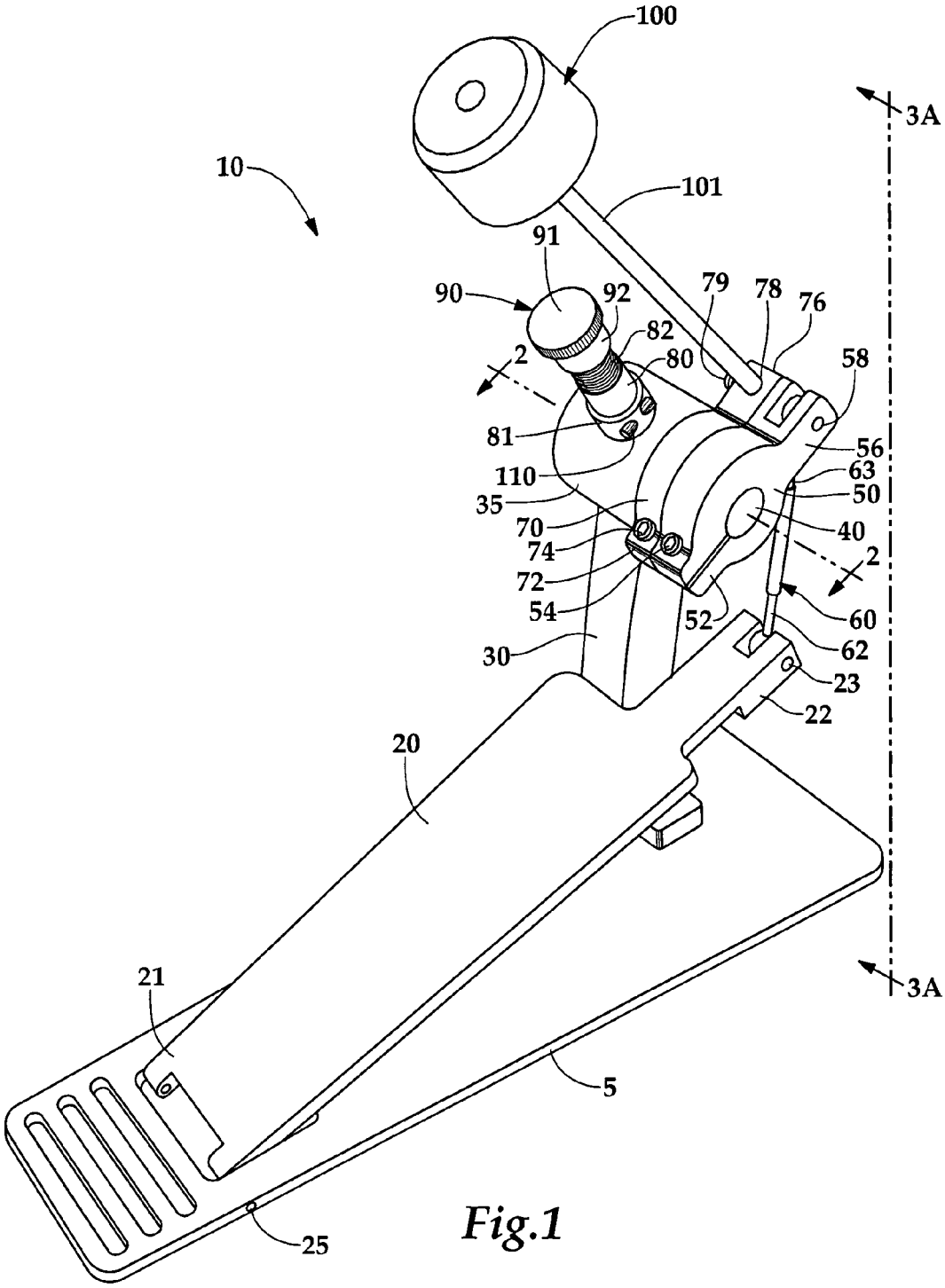
FIG. 1 is a perspective view of one embodiment of a bass drum pedal.
Figure 7:
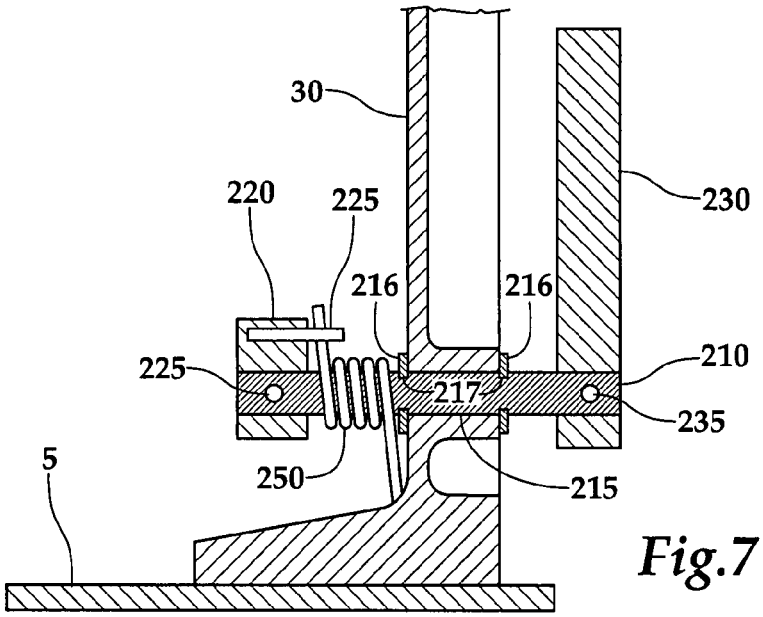
FIG. 7 is a cross section of the clamp of FIG. 6A along lines 7-7.
Figure 8:
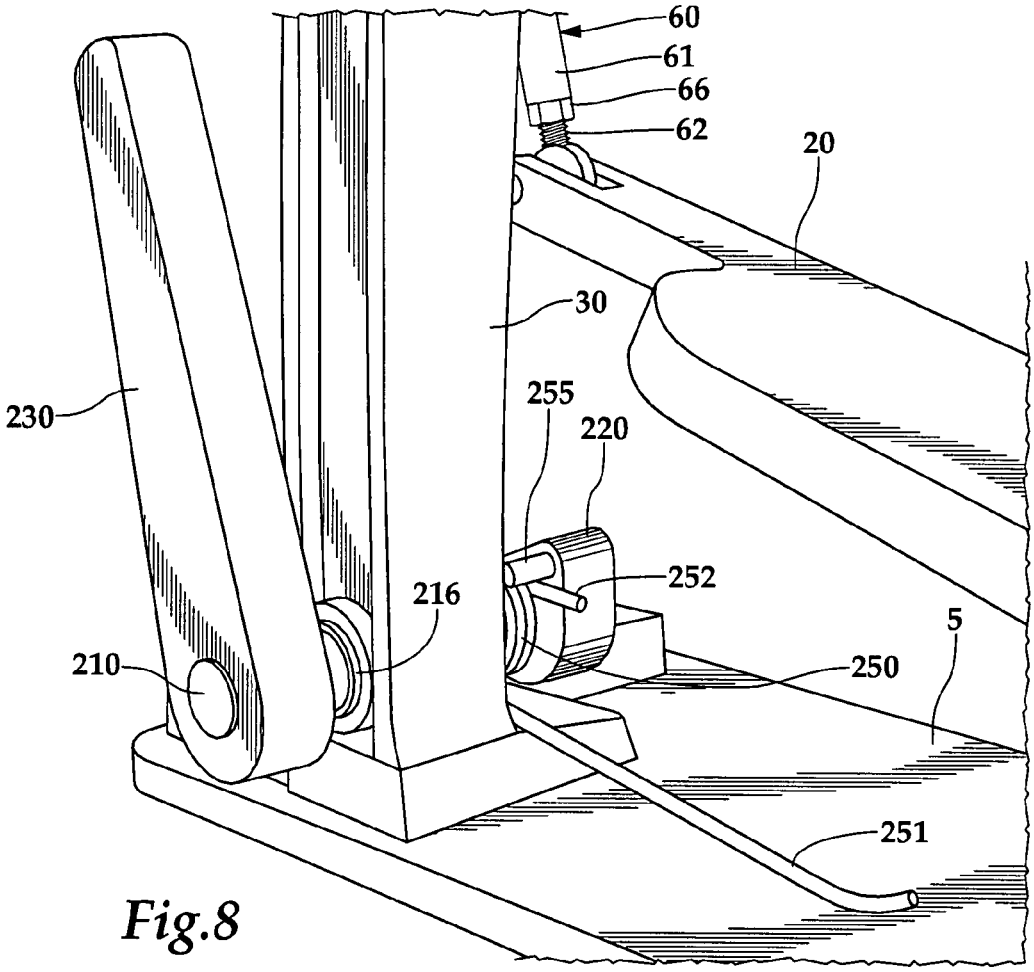
FIG. 8 is a perspective view of a clamp.

As shown generally in FIG. 1, drum pedal 10, having drive assembly 300 supported by pedestal 30, may include drive shaft 40, rotatably adjustable drive ring 50 having arm 56, and rotatably adjustable beater ring 70. Link 60 may connect foot board 20 with arm 56. Beater 100 may have stem 101 affixed to beater ring 70. Beater 100 may be actuated to a forward position when foot board 20 is depressed. Foot board 20 may be biased toward a raised position and beater 100 may be biased toward a rearward position. As shown generally in FIG. 2, in another aspect, drum pedal 10 may have drive assembly 300 with cam 150, having slope 166, mounted on drive shaft 40. Cam 150 and spring 120 may cooperate to bias cam follower 155 toward a predetermined rest position. Tension adjuster 90 may be provided to easily change the tension of spring 120. As generally shown in FIG. 6-8, in still another aspect, drum pedal 10 may have a drumward clamp 200 including shaft 210, rotatable arm 220, and torsion spring 250 for biasing arm 220 toward locking with a drum rim. Arm 220 may be unlocked by rotating lever 230 connected to shaft 210.

I. Adjustable Drive Ring and Beater Ring

As shown generally in FIG. 1, drum pedal 10, having drive assembly 300 supported by pedestal 30, may include drive shaft 40, rotatably adjustable drive ring 50 having arm 56, and rotatably adjustable beater ring 70. In one embodiment of FIG. 1, drum pedal 10 may have base 5, foot board 20, and beater 100 actuated by depression of foot board 20. The force exerted by foot board 20 on beater 100 may be adjustable through use of drive ring 50 and link 60. The arc distance beater 100 must travel in order to contact a drum may also be adjustable through beater ring 70. In one embodiment, drum pedal 10 shown in FIG. 1 may have base 5 that may be trapezoidal in shape. Foot board 20 may have two ends, heel end 21 and toe end 22. Heel end 21 may pivotally attach to base 5 by heel pin 25. Foot board 20 may reside at an incline in relation to base 5 with heel end 21 in contact with base 5 and toe end 22 suspended some distance above base 5. Foot board 20 may move from a raised position to a depressed position. The raised position also may be called a ready position and the depressed position may be called a strike position.

As shown in FIG. 1, pedestal 30 extends upwardly from base 5 and supports drive assembly 300. In one embodiment, pedestal 30 may have a support ring 35 near the top of pedestal 30. Pedestal 30 may be mounted on, and affixed to, base 5. There may be two pedestals 30 (not shown), but advantageously a single pedestal may be sufficient as shown in FIG. 1. Pedestal 30 and support ring 35 may be of unitary construction of aluminum casting and may be firmly affixed to base 5 by screws coming up from base 5 and extending into the base of pedestal 30. Unitary aluminum construction may prevent support ring 35 from twisting in relation to pedestal 30 and disorienting drive shaft 40. Drive shaft 40 should be oriented generally normal to the axis of the arc traveled by beater 100.

Drive shaft 40 may be journaled at one or more points along its axis or at both ends. As shown in FIG. 1, in one embodiment, drive shaft 40 may be journaled within housing or support ring 35. Drive shaft 40 extends generally horizontally through center of support ring 35. Support ring 35 may have a predetermined axial length sufficient to keep drive shaft 40 aligned generally normal to the axis of the arc traveled by beater 100. Axial length for a single support ring 35 may be between about 0.5 cm and about 10 cm, more preferably between about 1 cm and about 7 cm, and most preferably between about 2 cm and about 5 cm. If two or more support rings are provided, they should be spaced along drive shaft 40. As discussed below, two or more axially spaced bearings within support ring 35 may help keep drive shaft 40 substantially aligned.

As shown in FIG. 1, drive ring 50 may be one ring clamped onto drive shaft 40. Drive ring 50 may be adjustable in orientation about drive shaft 40. Drive ring 50 may have drive clamp protrusion 52 that may be slit from the end of drive clamp protrusion 52 to drive shaft 40 resulting in two drive protrusion ends that may be uncoupled from drive shaft 40. Drive ring screw 54 holds together both drive clamp protrusion ends to keep drive ring 50 tightly affixed to drive shaft 40. Drive ring 50 also may have arm 56 on the opposite end of drive ring 50 from drive clamp protrusion 52. Arm 56 may have link pin 58 that pivotally attaches to drive portion 63 of link 60. Link pin 58 may be spaced a predetermined distance from drive shaft 40 by arm 56. Arm 56 may provide leverage for force exerted on drive ring 50 by link 60. Toe portion 62 may be pivotally attached by toe pin 23 to toe end 22 of foot board 20.

Figure 4:
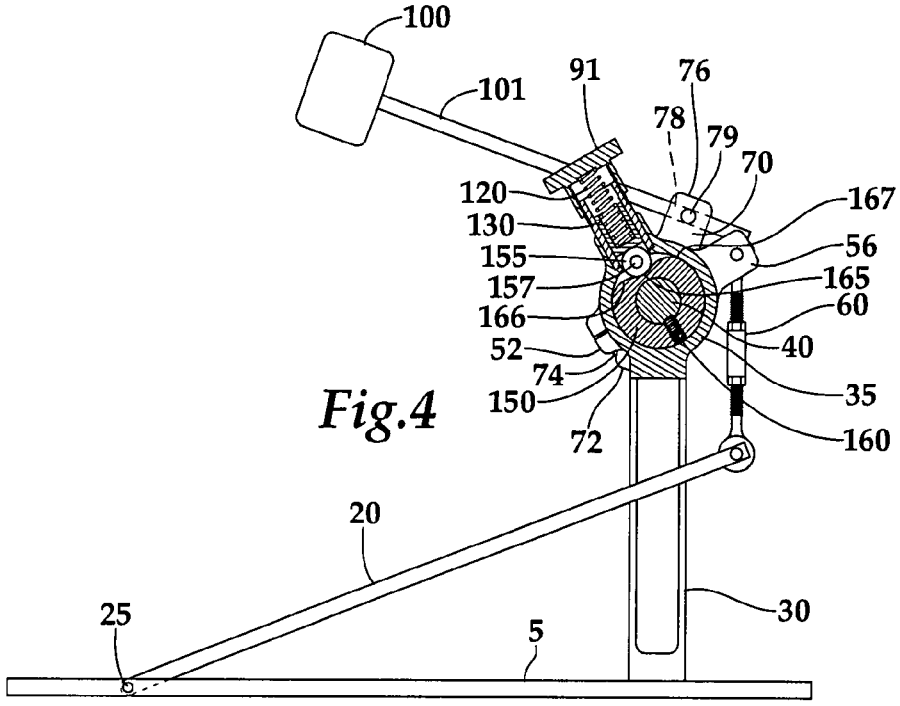
FIG. 4 is similar to FIG. 3A but shows a different beater angle.
Figure 5A:
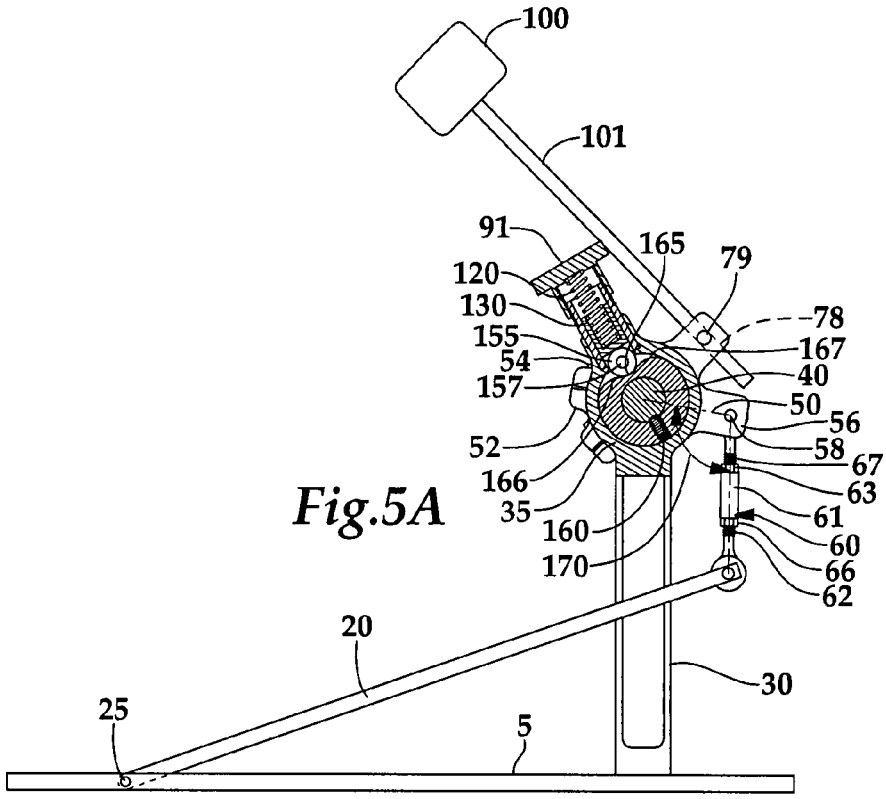
FIG. 5A is similar to FIG. 3A but shows an obtuse crank angle.
Figure 5B:
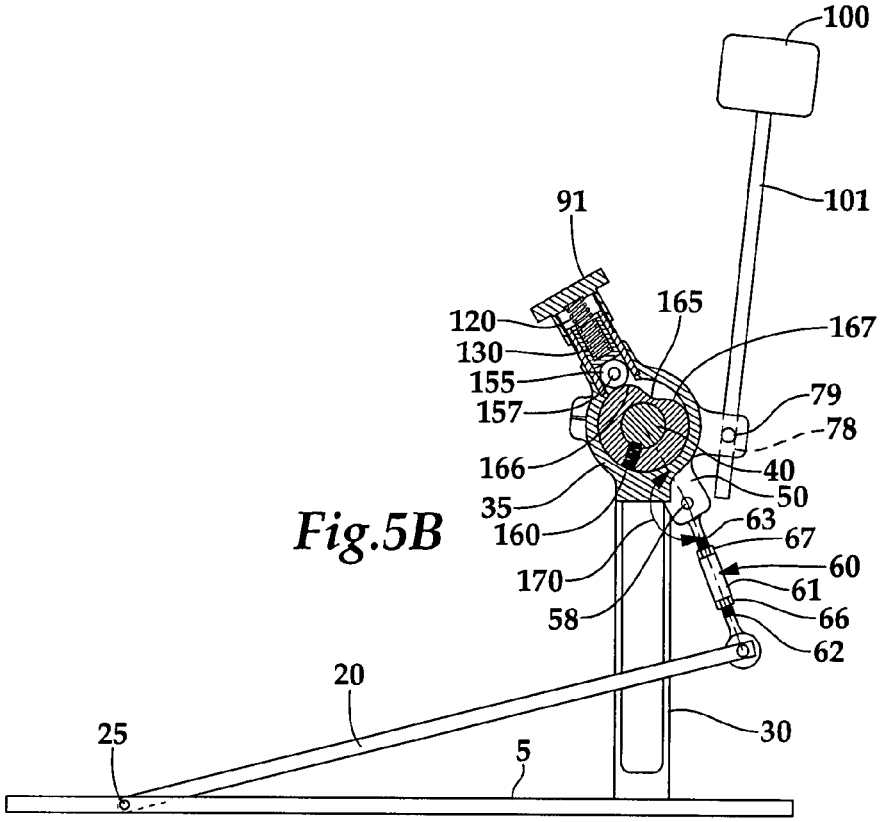
FIG. 5B is similar to FIG. 3A but shows a different crank angle in the strike position.

As shown in FIG. 5A and FIG. 5B, drive ring 50 may be adjusted to different orientations around drive shaft 40. Drummers are provided with a range of speed and a range of acceleration with which beater 100 moves toward a drum in order to best control the rhythm of the beat. Crank angle 170 may be formed at drive rod hinge 58 measuring the angle between link 60 and the line formed from drive shaft 40 to drive rod hinge 58. Crank angle 170 affects the speed with which the head of beater 100 may be accelerated toward the surface of the drum. When crank angle 170 is acute in the ready position, as seen in FIG. 4, the depression of foot board 20 may cause beater 100 to accelerate in velocity until crank angle 170 reaches 90 degrees, and then decelerate in velocity after crank angle exceeds 90 degrees. As seen in FIG. 5A and FIG. 5B when drive ring 50 is adjusted so that crank angle 170 is 90 degrees or more at the ready position, beater may decelerate towards drum surface upon depression of foot board 20. Since different drummers have different senses of timing, the a range of accelerations and decelerations of the beater is an important variable to have available.

In FIG. 5A, crank angle 170 is greater than 90 degrees at the ready position. Crank angle 170 may be changed by adjusting the orientation of drive ring 50. Drive ring screw 54 may be loosened so that drive clamp protrusion 52 may have two uncoupled ends. Loosening drive ring screw 54 allows drive ring 50 to unclamp from drive shaft 40. The orientation of drive ring 50 may be changed so that drive clamp protrusion 52 points horizontally or upwardly, as shown in FIG. 5. The more upwardly drive clamp protrusion 52 points, the greater crank angle 170 is. Tightening drive ring screw 54 may tightly couple the two ends of drive clamp protrusion 52, thus clamping drive ring 50 tightly to drive shaft 40 in the new orientation. Drive ring 50 preferably may have an about 120 degree range of adjustment, more preferably may have an about 100 degree range of adjustment, and most preferably may have an about 90 degree range of adjustment. Having adjustable drive ring 50 gives drummers many more options in controlling beater 100.

Figure 3A:
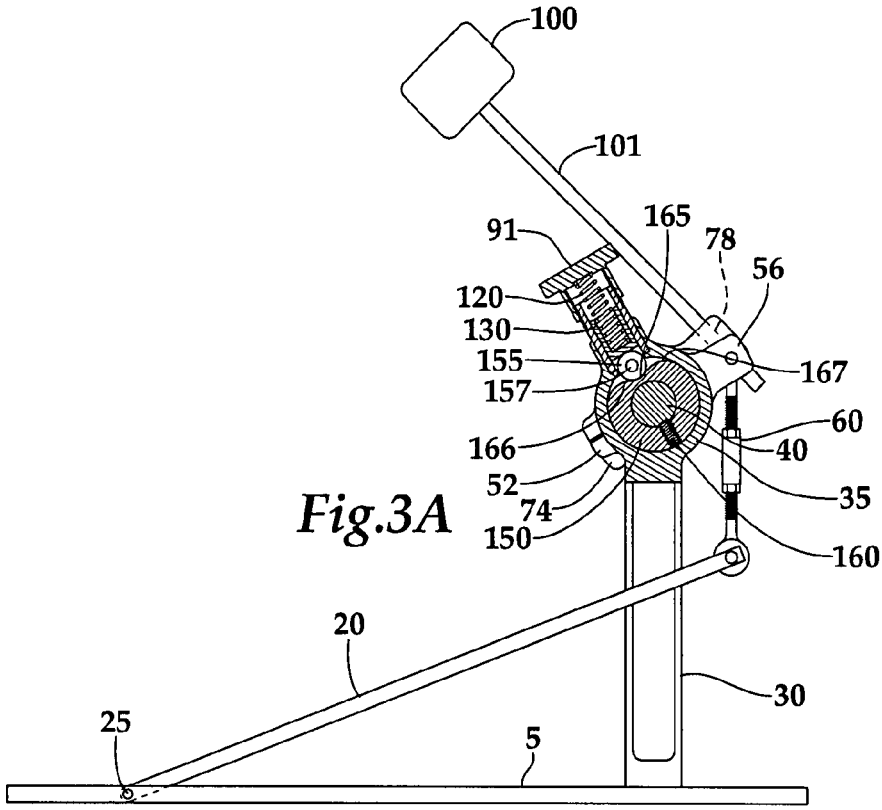
FIG. 3A is a cross section of bass drum pedal of FIG. 1 along lines 3A-3A.
Figure 3B:
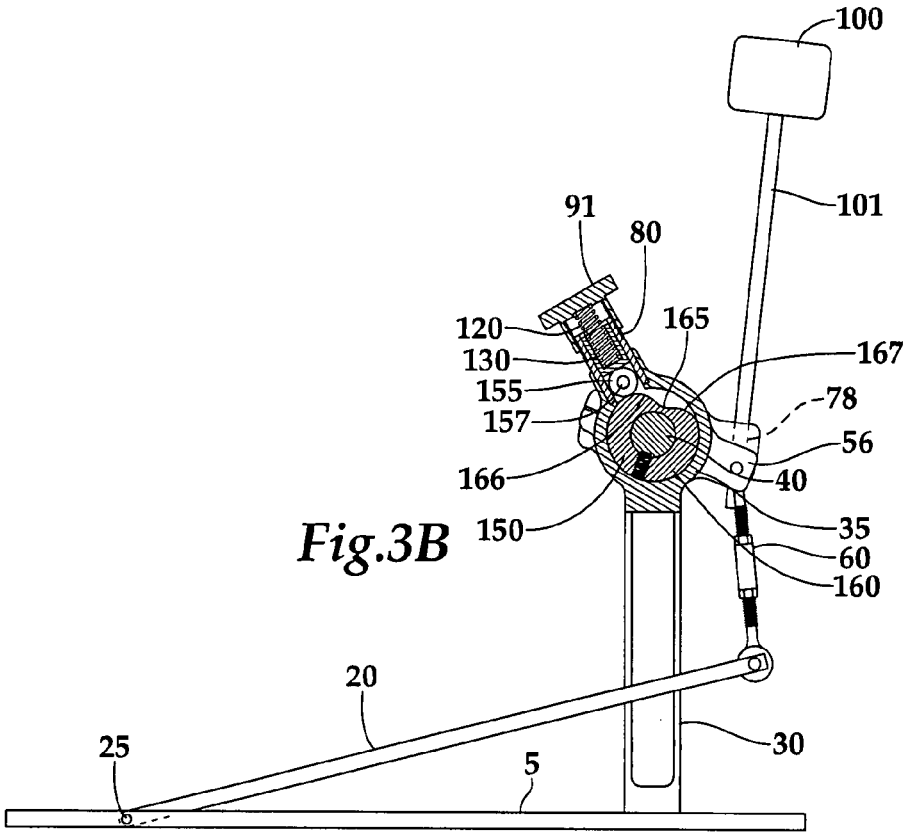
FIG. 3B is similar to FIG. 3A but shows a strike position.

As shown in FIG. 3-5, when crank angle 170 is adjusted, the length of link 60 also may have to be adjusted. Link 60 may have link body 61, toe portion 62, and drive portion 63. The length of link 60 may be adjustable by twisting link body 61 and securing link body 61 with toe nut 66 and drive nut 67. Link 60 may have left handed screw grooves located on toe portion 62 and right handed screw grooves located on drive portion 63. Link 60 may be shortened by twisting link body 61 to the right and lengthened by twisting link body 61 to the left. Shortening link 60 increases the angle of foot board 20 with respect to the floor. Toe nut 66 secures link body 61 by screwing to toe portion 62. Drive nut 67 secures link body 61 by screwing to drive portion 63. When drive ring 50 is adjusted about drive shaft 40 so that crank angle 170 is acute, as seen in FIG. 3A and FIG. 3B, link 60 may have to be lengthened so that foot board 20 may not be inclined too steeply as to be uncomfortable to operate. When crank angle 170 is obtuse, as seen in FIG. 5A and FIG. 5B, link 60 may have to be shortened so that foot board 20 may not hit base 5 during depression.

As generally shown in FIG. 4, besides adjustable drive ring 50, drum pedal 10 may also have adjustable beater ring 70. Adjustable beater ring 70 allows a drummer to set the predetermined arc distance beater 100 must travel to strike a drum. Beater ring 70 may be situated between drive ring 50 and support ring 35. Beater ring 70 may have beater clamp protrusion 72 that may be slit from the end of beater clamp protrusion 72 to drive shaft 40 resulting in two beater protrusion ends. Beater ring screw 74 screws together both beater protrusion ends to keep beater ring 70 tightly affixed to drive shaft 40. Beater ring 70 also may have holder protrusion 76 on opposite end of beater ring 70 from beater clamp protrusion 72 and holder protrusion 76 may have beater stem hole 78 extending through holder protrusion 76 for holding stem 101 of drum beater 100. Beater stem screw 79 fits into the side of holder protrusion 76 to hold stem 101. Beater stem screw 79 may be loosened to adjust the length of stem 101 held between holder protrusion 76 and beater 100. Beater stem screw 79 may be tightened to keep stem 101 from moving within beater stem hole 78. Beater 100 may be actuated by drive shaft 40 in connection with foot board 20 from a rearward position to a strike position. The rearward position may be called the ready position and occurs when foot board 20 is in the raised position. The strike position may be when foot board 20 is in a depressed position.

As shown in FIG. 4, beater ring 70 may be adjustable to control the arc distance beater 100 travels to strike the surface of a drum. Beater 100 may be set so stem 101 is oriented close to perpendicular and beater 100 travels a short arc distance before striking the surface of the drum. Foot board 20 may not need to be depressed very far to actuate beater 100 to strike the surface of the drum when stem 101 is oriented close to perpendicular. As seen in FIG. 4, beater 100 may be set so that stem 101 is oriented closer to horizontal at the ready position. When beater 100 is oriented as seen in FIG. 4, beater 100 may have to travel a longer arc distance to strike the surface of the drum. Foot board 20 may have to be depressed a greater distance downwardly to actuate beater 100 to travel the longer arc distance to the surface of the drum from the ready position. The distance of the beater arc may also affect the speed at which beater 100 strikes the surface of the drum. A longer arc distance allows beater 100 more time to accelerate towards the drum. An adjustable beater ring 70 allows drummers more options in fine tuning the operation of their instruments.

Beater ring screw 74 may be loosened so that beater clamp protrusion 72 may have two uncoupled ends. Loosening beater ring screw 74 allows beater ring 70 to unclamp from drive shaft 40. The orientation of beater ring 70 may be changed so that beater clamp protrusion 72 points more downwardly, as shown in FIG. 4. This causes beater stem hole 78 to orient close to horizontal and causes beater 100 to travel a longer arc distance to strike the drum. Tightening beater ring screw 74 may tightly couple the two ends of beater clamp protrusion 72, thus clamping beater ring 70 tightly to drive shaft 40 in the new orientation. The angles of adjustment of beater ring 70 may preferably be between about 100 degrees from horizontal and about the angle of the surface of the drum, more preferably between about 80 degrees from horizontal and about the angle of the surface of the drum, and most preferably between about 60 degrees and about the angle of the surface of the drum.

Figure 2:
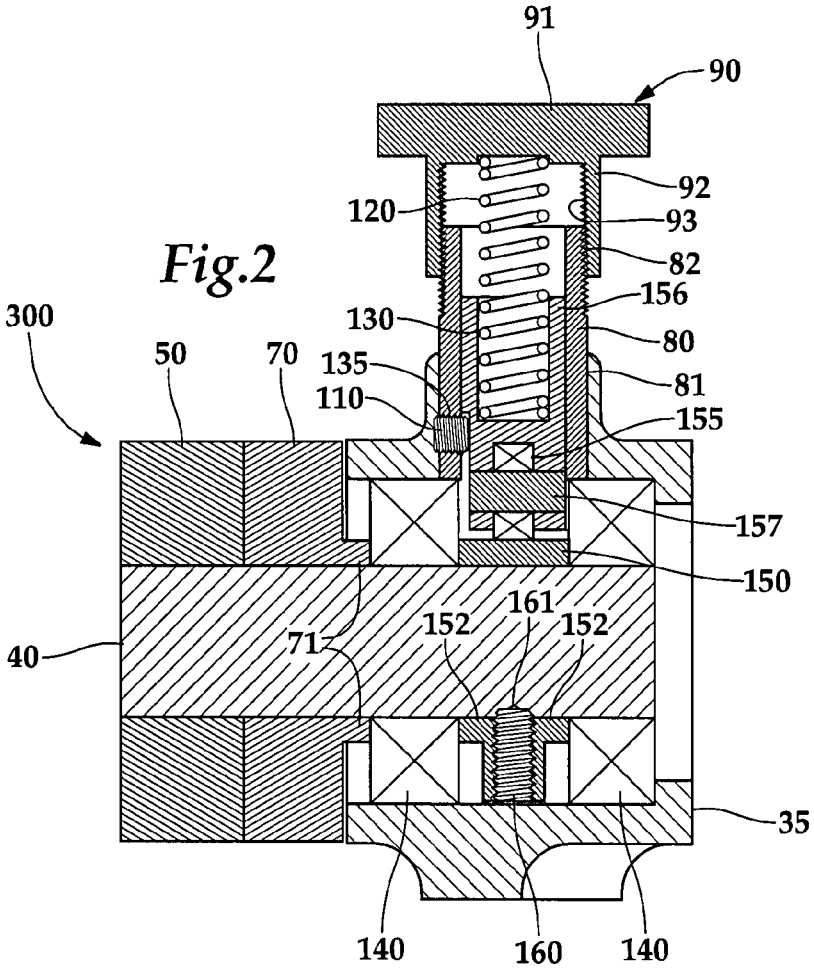
FIG. 2 is a cross section of the drive assembly of FIG. 1 along lines 2-2.

Foot board 20 actuates beater 100 through drive assembly 300. In FIG. 2, drive assembly 300 may have drive shaft 40 with a generally horizontal axis journaled within drive assembly 300. In a preferred embodiment, drive shaft 40 may be positioned generally horizontally by support ring 35. Drive assembly 300 comprising drive ring 50, beater ring 70, roller bearings 140, and cam 150, all affixed to drive shaft 40 may be suspended in place by drive shaft 40 partially extending through support ring 35. Roller bearings 140 and cam 150 actually reside within support ring 35.

Tube 80, with screw grooves 82, fits within tube support 81 and extends away from support ring 35. Tube 80 may contain a compression spring 120. Tension adjuster 90 may have spring cylinder 92 that fits over spring 120 and partially houses spring 120. Tension adjuster 90 also may have handle 91 to enable easy twisting of tension adjuster 90. Spring cylinder 92 may have cylinder grooves 93 on inside of spring cylinder 92 to screw into screw grooves 82 on tube 80. Twisting tension adjuster 90 allows easy adjustment of the tension of spring 120 without tools. Adjusting tension of spring 120 affects the force necessary to actuate beater 100 toward a drum. The higher the tension of spring 120, the more force necessary to actuate beater 100. The more spring cylinder 92 may overlap with tube 80, the more spring 120 may be compressed and the higher the spring tension may be.

Preferably tube 80 may be located at between about 45 degrees and about 80 degrees with respect to base 5, more preferably at between about 50 degrees and about 70 degrees with respect to base 5, and most preferably at about 60 degrees with respect to base 5. The angle of tube 80 should be optimal for a drum player to make adjustments to the spring tension by twisting handle 91 of tension adjuster 90.

II. Cam

As shown generally in FIG. 2, in another aspect, drum pedal 10 may have drive assembly 300 with cam 150, having slope 166, mounted on drive shaft 40. Cam 150 and spring 120 may cooperate to bias cam follower 155 toward a predetermined rest position. Tension adjuster 90 may be provided to easily change the tension of spring 120. Cam 150 may be affixed to drive shaft 40 by cam locking screw 160 which penetrates cam 150 through a hole which extends from the perimeter of cam 150 to its center, and contacts dimple 161 in drive shaft 40. When cam locking screw 160 may be in place, the edge of cam locking screw 160 may be even with the perimeter of cam, and the point of cam locking screw 160 may be in contact with dimple 161 on drive shaft 40.

As shown in FIG. 2, roller bearings 140 contact drive shaft 40 and facilitate rotation of drive shaft 40 about its axis. Preferably there are two roller bearings 140 spaced on either side of cam 150 to help keep drive shaft 40 substantially aligned axially. Cam 150 may have cam flanges 152 in order to space cam 150 apart from roller bearings 140. Cam plunger 130 may be wider than cam follower 155 and cam plunger 130 may interfere with roller bearings 140 when cam follower 155 rolls along cam 150. Cam flanges 152 create space on either side of cam 150 so cam plunger 130 may not interfere with roller bearings 140 during operation of cam 150. Roller bearings 140 are preferably double shielded R12 bearings and are located on either side of cam 150. Beater ring 70 may have beater flanges 71 to space beater ring 70 apart from roller bearings 140 to ensure beater ring 70 may not interfere with the function of roller bearings 140.

As generally shown in FIG. 2, cam plunger 130 fits within tube 80 and may have cam follower 155 at one end and spring end 156 at the other end for partially housing spring 120. Cam 150 cooperates with spring 120 to bias cam follower 155 toward a predetermined position on cam 150. The cooperation of cam 150 with spring 120 provides an easy way to control the force needed to actuate beater 100. Compression of spring 120 within tube 80 biases cam plunger 130 with cam follower 155 toward cam 150. Cam follower 155 preferably may be a wheel that may attach to an end of cam plunger 130 by cam axle 157. Cam follower 155 contacts and rolls along outer perimeter surface of cam 150. Locking pin 110 fits in a hole that extends through tube support 81 and tube 80. Locking pin 110 contacts cam plunger 130 at pin niche 135 which may be an area under a shoulder on the side of cam plunger 130. Locking pin 110 keeps cam plunger 130 oriented such that cam follower 155 may roll along only the outer perimeter surface of cam 150. When locking pin 110 extends through tube support 81 and tube 80, and contacts pin niche 135, cam plunger 130 cannot turn within tube 80.

FIGS. 3A and 3B show the engagement of cam follower 155 with cam 150 in the ready position. Cam follower 155 may roll in same plane as cam 150 pivots. Cam 150 may have a predetermined position adjacent to drive slope 166 into which cam follower 155 may be biased. In a preferred embodiment, cam 150 may have indentation 165 between two generally convexly curved slopes, drive slope 166 and retention slope 167. In the preferred embodiment, the predetermined position may be located in indentation 165. Slopes 166 and 167 curve inwardly (toward the cam axis) in the region of indentation 165. Cam follower 155 may naturally rest at indentation 165 because spring 120 may be at its most extended state when cam follower 155 may be positioned there. Spring 120 may be a compression spring and may be at its lowest potential energy when at its most extended state. When cam follower 155 may be at rest in indentation 165, as seen in FIG. 3A, drum pedal 10 may be in the ready position and beater 100 may be held in a rearward position away from the surface of a drum by stem 101 held in beater ring 70. Spring 120 may be easily adjustable by tension adjuster 90 and the shape of cam 150 allows tension of spring 120 to affect rotation of cam 150. The higher the tension of spring 120, the greater the biasing force on cam follower 155.

In FIG. 3B, drum pedal 10 may be in the strike position. In the strike position, foot board 20 may be depressed, link 60 pulls arm 56 downwards, and roller bearings 140 turn within support ring 35 to allow drive shaft 40 to pivot in the clockwise direction. Cam 150 locked to drive shaft 40 may also pivot clockwise and cam follower 155, fixed to the end of cam plunger 130 held in place by tube 80, may be forced to roll up drive slope 166. When beater 100 contacts the surface of the drum at the strike position, cam follower 155 may be in contact with a portion of drive slope 166 and spring 120 may be compressed within tube 80. Spring 120 may be adjusted to have a high spring tension, and more force may be required to pivot cam 150 and move cam follower 155 onto drive slope 166. Adjusting spring tension by adjuster 190 adjusts the force necessary to pivot cam 150 and therefore, the force necessary to depress foot board 20 and move beater 100 into the strike position.

As shown in FIG. 3B, depression of foot board 20 actuates beater 100 into traveling an arc distance toward a drum. Drive slope 166 and retention slope 167 on cam 150 allow beater 100 to actuate at a range of preferably between about 90 degrees forward and about 90 degrees backward from the ready position, more preferably between about 75 degrees forward and about 75 degrees backward from the ready position, and most preferably between about 60 degrees forward and about 60 degrees backward from the ready position. The degree beater 100 actuates toward a drum may depend on the length of drive slope 166. The longer the length of drive slope 166, then the larger the range of arc lengths that beater 100 may actuate.

When foot board 20 is released, pressure exerted by compressed spring 120 on cam plunger 130 may force cam follower 155 to roll towards indentation 165 back to the ready position because spring 120 may be more extended when at rest in indentation 165 than on drive slope 166. If cam follower 155 rolls past indentation 165 onto retention slope 167 after release of foot board 20, cam follower 155 may roll back towards indentation 165 because retention slope 167 also compresses spring 120. Thus, retention slope 167 ensures that cam follower 155 returns to indentation 165 and drum pedal 10 returns to the ready position when foot board 20 is not depressed.

III. Clamp

As generally shown in FIG. 6-8, in still another aspect, drum pedal 10 may have a drumward clamp 200 including shaft 210, rotatable arm 220, and torsion spring 250 for biasing arm 220 toward locking with a drum rim. Arm 220 may be unlocked by rotating lever 230 connected to shaft 210. Clamp 200 using spring 250 may be attached to drum pedal 10 to hold and position a bass drum in front of drum pedal 10. Drum pedal 10 may have drumward end 201 that includes pedestal 30. Base 5 may have drumward end 202 that may include the entire upper surface of base 5, and more preferably includes the front half of base 5, and most preferably the front third of base 5.

Figure 6A:
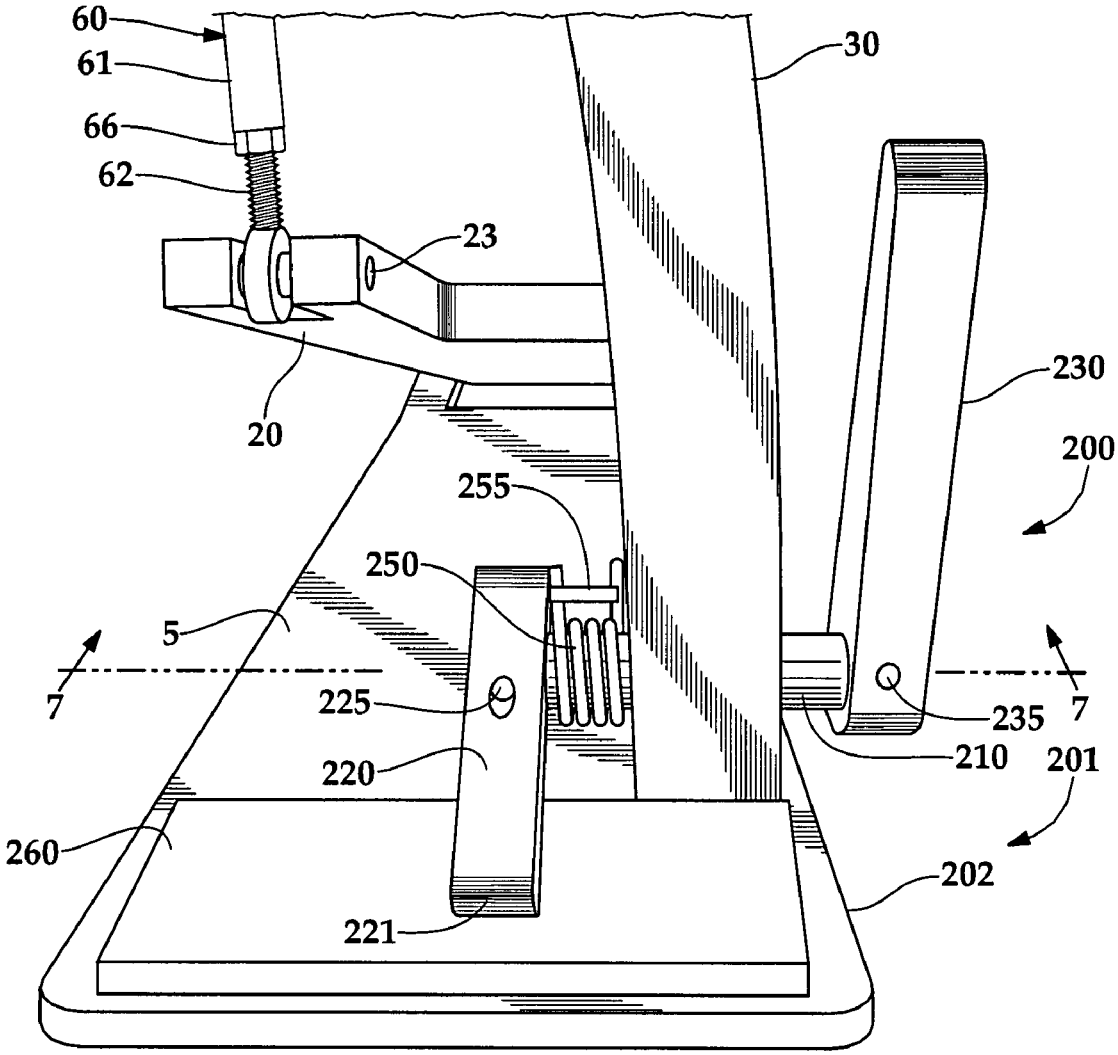
FIG. 6A is a front view of a clamp.
Figure 6B:
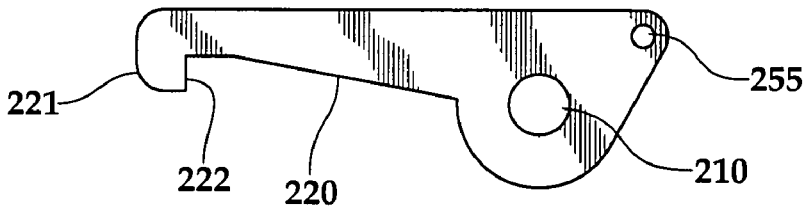
FIG. 6B is a side view of a clamp arm.

In one embodiment, as seen in FIG. 6A, clamp 200 comprises shaft 210 extending through the base of pedestal 30, arm 220 affixed to shaft 210 by arm screw 225, lever 230 affixed to shaft 210 by lever screw 235, and torsion spring 250 encircling shaft 210. Rubber 260 placed in front of arm 220 on drumward end 202 of base 5 helps cushion a bass drum when the drum is in position to be played, and also helps hold the drum in place because rubber 260 may be soft and moldable about the bass drum. As seen in FIG. 6B, arm 220 may have rim hook 221 with back surface 222 to securely lock to the drum rim and keep the drum from moving. Rim hook 221 and back surface 222 may contact the drum rim.

As seen in FIG. 7, shaft 210 turns inside bushing 215 that may be integral to pedestal 30. Snap rings 216 fit into grooves 217 in shaft 210 directly next to either side of bushing 215 to hold shaft 210 from shifting in pedestal 30. Arm screw 225 holds arm 220 securely to shaft 210. Lever screw 235 holds lever 230 securely to shaft 210. Torsion spring 250 encircles shaft 210 adjacent to arm 220. Torsion spring 250 biases arm 220 into a locking position with a drum rim.

As seen in FIG. 8, in one embodiment, torsion spring 250 may have two legs, long leg 251 and short leg 252. Torsion spring 250 may be compressed when long leg 251 and short leg 252 are pinched toward each other. In a preferred embodiment, long leg 251 may push against base 5, and short leg 252 may push against stop or pin 255 mounted to arm 220. Torsion spring 250 biases pin 255 and causes arm 220 to lock with a drum rim.

Arm 220 may be positioned as shown in FIG. 6A. Drum clamp 200 may be in the locked position as shown. To unlock drum clamp 200, pressure may be applied to lever 230. In one embodiment, unlocking drum clamp 200 involves torquing lever 230 clockwise towards pedal 20. Preferably, lever 230 may be torqued between about 30 degrees and about 60 degrees toward foot board 20, more preferably between about 40 degrees and about 50 degrees toward foot board 20, and most preferably about 45 degrees toward foot board 20, to achieve an unlocked position. In the unlocked position, the rim of a drum may be placed on rubber 260. Drum clamp 200 should be easy to operate because there are no screws to manipulate to position arm 220 in place to securely hold the rim of a bass drum. In a preferred embodiment, no tools are necessary to move lever 230. Hand strength may be sufficient to move lever 230 and unlock the drum rim from arm 220.

In another embodiment of the invention (not shown), a structure on shaft 210 allows a lever (such as a drum stick) to be operatively engageable to shaft 210 where the lever could rotate shaft 210 to an unlocked position. In other words, a lever may not necessarily have to be affixed to shaft 210.

As shown generally in FIG. 1, in further summary of an adjustability aspect, drum pedal 10 may have base 5, foot board 20, pedestal 30 extending upwardly from base 5, drive assembly 300 supported by pedestal 30 having a journaled drive shaft 40, rotatably adjustable drive ring 50 mounted on drive shaft 40 having arm 56, rotatably adjustable beater ring 70 mounted on drive shaft 40, link 60 connecting foot board 20 with arm 56, beater 100 having stem 101 affixed to beater ring 70, wherein beater 100 is actuated to a forward position when foot board 20 is depressed, and wherein foot board 20 may be biased into a raised position and beater 100 may be biased into a rearward position.

In other aspects, drive assembly 300 may contain at least one bearing 140 enabling drive shaft 40 to rotate. Foot board 20 bias and beater 100 bias may be provided by spring 120. Drive shaft 40 may be journaled within support ring 35, and support ring 35 may have a predetermined axial length sufficient to keep drive shaft 40 aligned substantially axially. Link 60 may be adjustable within a predetermined range of length. Pedestal 30 may be made from an aluminum casting.

As generally shown in FIG. 2, in summary of a cam aspect, drum pedal 10 may have base 5, foot board 20, pedestal 30 extending upwardly from base 5, drive assembly 300 supported by pedestal 30 having journaled drive shaft 40, cam 150 mounted on drive shaft 40 having drive slope 166, spring 120, and cam follower 155, wherein cam 150 and spring 120 cooperate to bias cam follower 155 toward a predetermined rest position, link 60 operatively connecting foot board 20 to drive shaft 40, beater 100 having stem 101 operatively connected to drive assembly 300, wherein cam follower 155 may be moved onto drive slope 166 when foot board 20 may be depressed. Spring 120 may be a compression spring. Drum pedal 10 also may have tension adjuster 90 for spring 120. Cam 150 may be further provided with retention slope 167 and indentation 165 between drive slope 166 and retention slope 167, wherein the predetermined rest position is in indentation 165.

As generally shown in FIGS. 6-8, in summary of a clamp aspect of drum pedal 10, drum pedal 10 may have drumward end 201, base 5 having drumward end 202, movable foot board 20 situated above base 5, beater 100 operatively connected to foot board 20 and actuated thereby, clamp 200 operatively connected to drumward end 201 of drum pedal 10, having shaft 210, rotatable arm 220 mounted to shaft 210, torsion spring 250 mounted around shaft 210 and biasing arm 220 to lock with a drum rim, and lever 230 operatively connected to shaft 210 rotatable to unlock arm 220 from the drum rim. Drum pedal 10 may also have pedestal 30 extending upwardly from base 5, wherein clamp 200 is operatively connected to pedestal 30. Arm 220 may also have a stop for engaging torsion spring 250. Drumward end 202 may be provided with gripping surface 260 generally opposite arm 220.

IV. Biasing Arm Drum Pedal Embodiment

In biasing arm drum pedal embodiment 310 shown in FIGS. 9-12, drum pedal 310 is substantially the same as drum pedal embodiment 10 previously described, with one notable difference being a different drive assembly 345 to control rotation of drive shaft 340. Drum pedal 310 has pedestal 330 extending upwardly from base 305. Link 360 connects foot board 320 to drive assembly 345. Drive assembly 345 has journaled drive shaft 340 and biasing bearing 490 mounted off center of drive shaft 340. Drive assembly 345 may be supported within support ring 335. Beater 400 may be held by stem 401 in beater ring 370 in holder protrusion 376.

Figure 9:
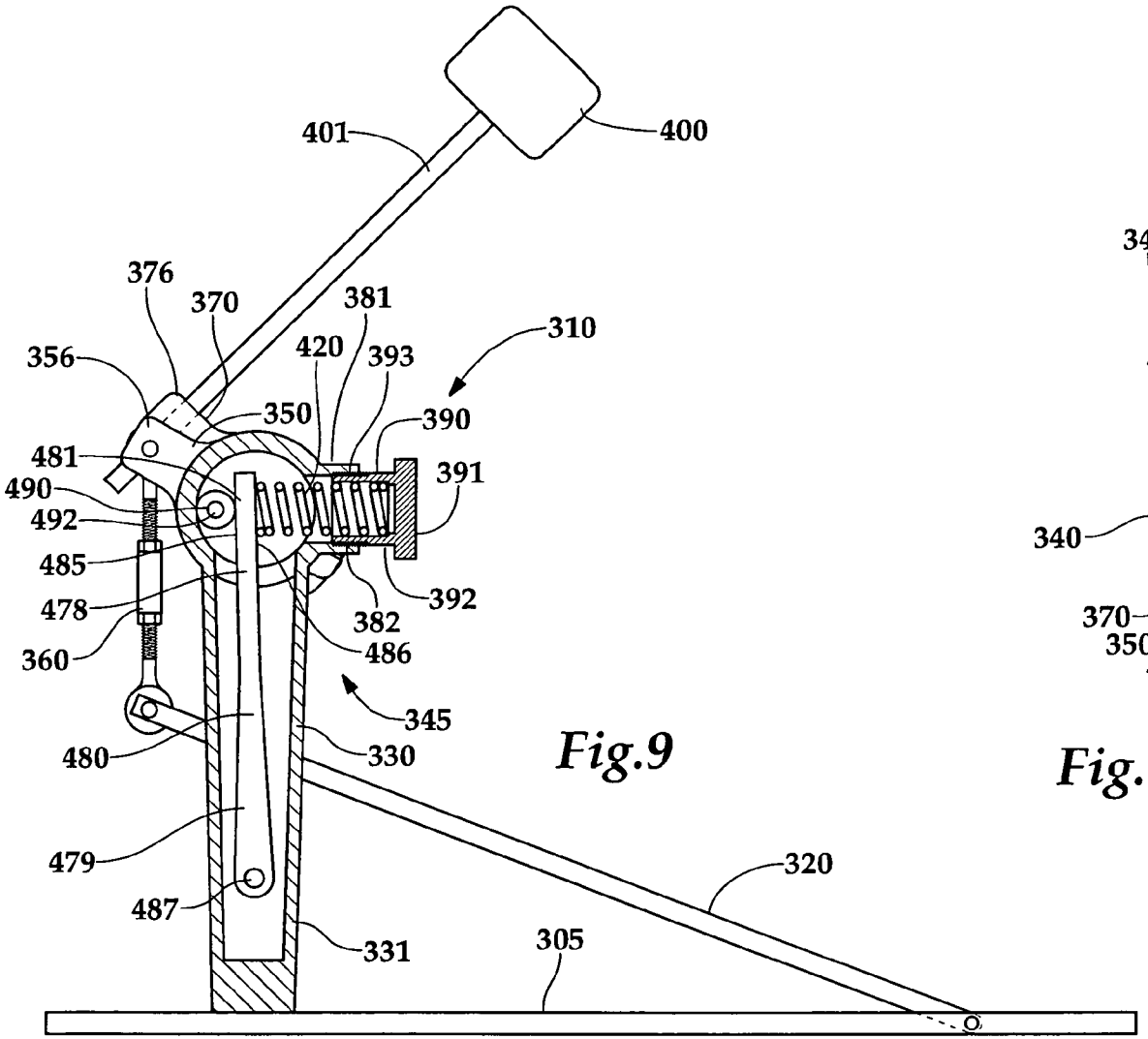
FIG. 9 is a section view of biasing arm embodiment of bass drum pedal in a ready position.
Figures 11, 12:
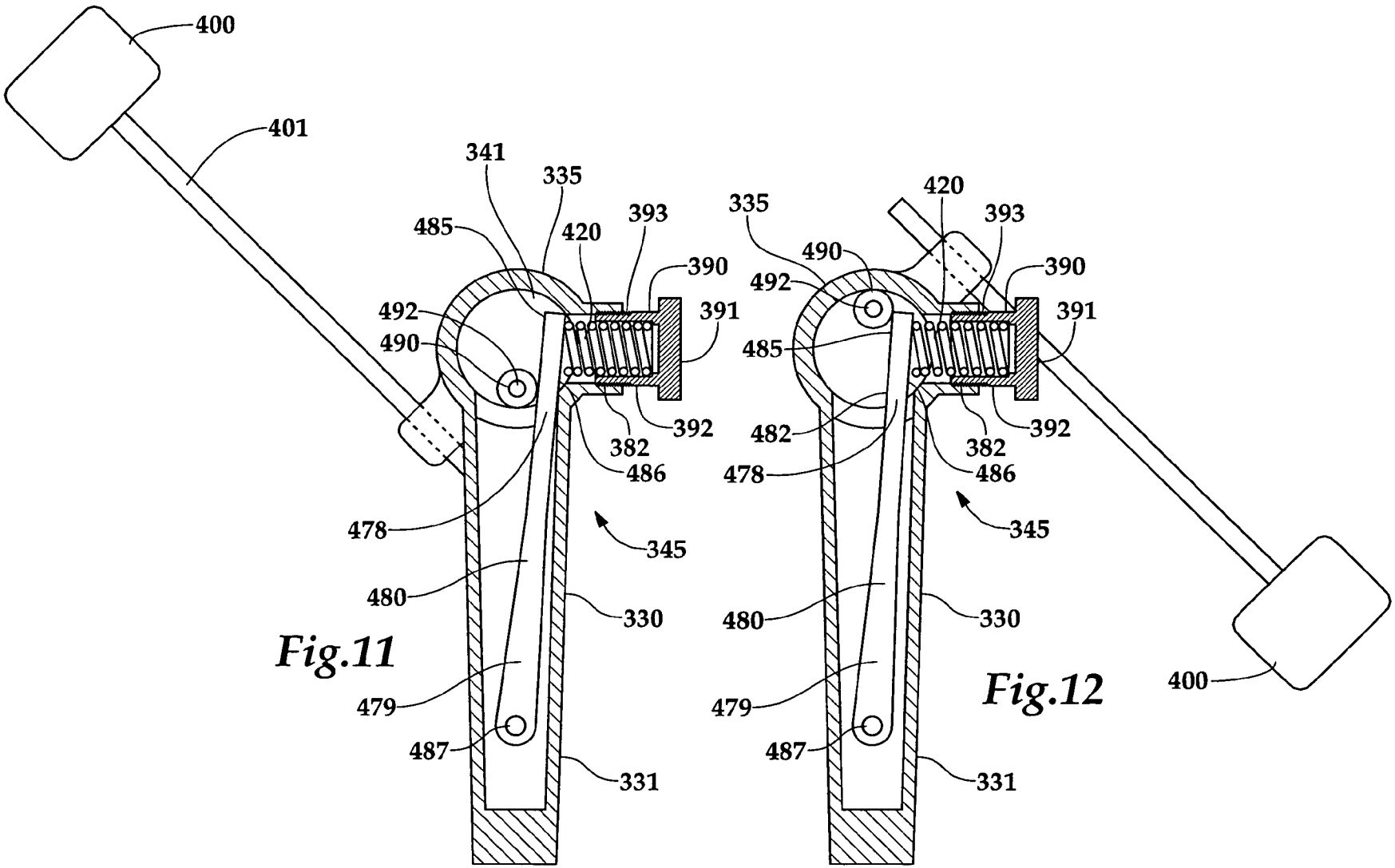
FIG. 11 is a section view similar to FIG. 9 showing a drive mechanism in a forward position.
FIG. 12 is a section view similar to FIG. 9 showing a drive mechanism in a retention position.

As shown in FIGS. 9, 11 and 12, biasing arm 480 has biasing end 478, positioned between biasing bearing 490 and spring 420, and pivot end 479, which may be rotatably connected to bottom portion 331 of pedestal 330 by pivot pin 487. Biasing bearing 490 and spring 420 cooperate together to contact biasing end 478 and position biasing arm 480 in a ready position when foot board 320 is not depressed. When biasing arm 480 is in a ready position, beater 400 is in a rearward position, as shown in FIG. 12, and foot board 320 may be in a raised position. Beater 400 may be actuated to a forward position when foot board 320 is depressed. Biasing arm 480 preferably may be between about 3 inches and about 7 inches in length, more preferably between about 4 inches and about 6 inches in length, and in one embodiment about 5 inches in length. Pivot end 479 may be rotatably connected within about 4 inches from the bottom of pedestal 330, more preferably within about 3 inches from the bottom of pedestal 330, and in one embodiment within 2 inches about the bottom of pedestal 330.

As shown in FIG. 9, spring 420 may be housed within tube support 381 and spring cylinder 392, which is a portion of tension adjuster 390. By twisting knob 391 on tension adjuster 390 counterclockwise, outer threads 393 on spring cylinder 392 screw into inner threads 382 on tube support 381 and compresses spring 420 and thus increases the tension of spring 420. When spring 420 is compressed and spring tension increases, foot board 320 becomes more difficult to depress. Tube support 381 is located at an angle with respect to the longitudinal axis of pedestal 330, preferably at between about 30 and about 150 degrees, more preferably between about 60 and about 120 degrees, and in one embodiment at about 90 degrees with respect to the longitudinal axis of pedestal 330. The angle of tube support 381 should be optimal for a player to adjust the tension of spring 420.

Figure 10:
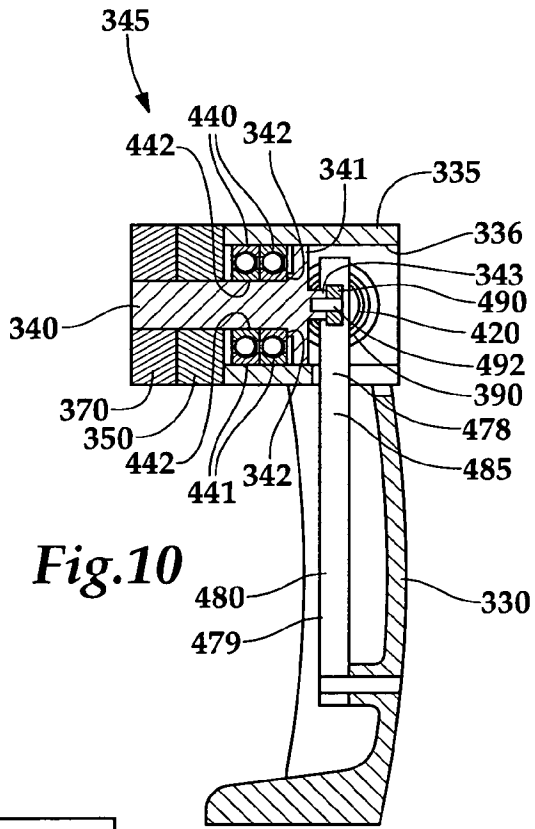
FIG. 10 is a section view of drive mechanism of biasing arm embodiment, enlarged to show details, and rotated 90 degrees from the view of FIG. 9.

As shown in FIGS. 9 and 10, drive assembly 345 is positioned by support ring 335 and comprises drive ring 350 and beater ring 370 clamped to drive shaft 340. Drive ring 350 may have arm 356 that connects to foot board 320 via link 360. Beater ring 370 may have holder protrusion 376 for holding stem 401 of beater 400. As shown in FIG. 10, drive shaft 340 is cylindrically shaped with flange 341 which contacts inner surface 336 of support ring 335 and positions drive shaft 340 securely in a horizontal position. Drive shaft 340 rotates within support ring 335.

As shown in FIG. 10, roller bearings 440 are located within support ring 335 and encircle drive shaft 340. In the embodiment shown, there are two roller bearings 440 adjacent one another along drive shaft 340. Outer raceway 441 of roller bearings 440 contacts inner surface 336 of support ring 335. Inner raceway 442 of roller bearings 440 contact and encircle drive shaft 340. Drive shaft 340 has shoulder 342, adjacent to flange 341, which abuts an end face of inner raceway 442 of one of roller bearings 440. Shoulder 342 spaces roller bearings 440 from flange 341 and ensures roller bearings 440 rotate unimpeded.

Continuing with FIG. 10, shaft tip 343, as shown in FIGS. 9, 11 and 12, may extend off-center from flange 341. Biasing bearing 490 is locked by bearing pin 492 onto shaft tip 343. Biasing bearing 490 rotates about bearing pin 492 when foot board 320 is depressed.

As shown in FIG. 9-12, biasing end 478 of biasing arm 480 is located between biasing bearing 490 and spring 420. Biasing arm 480 has biasing bearing surface 485 which contacts biasing bearing 490. Biasing arm 480 may be attached near bottom portion 331 of pedestal 330 by biasing arm pivot 487, preferably biasing arm may be in the bottom third of pedestal 330. Spring 420 and biasing bearing 490 cooperate together to position biasing arm 480 towards the ready position, as shown in FIG. 9. At the ready position, spring 420 may be at its most extended state for this embodiment. Biasing arm 480 may be between about one half and about ⅔ of the height of pedestal 330, preferably biasing arm 480 may be between about ⅝ and about ⅞ of the height of pedestal 330, and in the embodiment shown may be about 5/7 of the height of pedestal 330.

As seen in FIGS. 11 and 12, biasing arm 480 has a range of motion of between about 100 degrees and about 250 degrees, preferably a range of between about 130 degrees and about 220 degrees, and in the embodiment shown a range of about 180 degrees. From ready position, beater 400 rotates toward the drum at a range of between about 60 degrees and about 120 degrees, preferably between about 80 degrees and about 100 degrees, and in the embodiment shown about 90 degrees. When beater 400 contacts the surface of the drum, biasing arm 480 may be in an actuated position in which foot board 320 may be depressed and beater 400 may be in a forward position, as shown in FIG. 11. From the ready position as shown in FIG. 9, beater can rotate backwardly (i.e., away from the drum) at a range of between about 60 degrees and about 120 degrees, preferably between about 80 degrees and about 100 degrees, and in the embodiment shown about 90 degrees.

Spring 420 may be a compression spring and the spring tension coupled with biasing bearing 490 on drive shaft 340 may force biasing arm 480 to the ready position, as shown in FIG. 9. Spring 420 contacts biasing spring surface 486 of biasing arm 480. Tension of spring 420 may be adjusted by twisting tension adjuster 390. Tension adjuster 390 has knob 391 and spring cylinder 392. Spring 420 may be housed within tube support 381 and spring cylinder 392. As noted above, spring cylinder 392 has outer threads 393 that engage inner threads 382 on tube support 381. This engagement holds tension adjuster 390 in place and controls the compression of spring 420.

Biasing bearing surface 485 may have three positions, a rest position, an actuated position, and a retention position. As shown in FIG. 9, at the ready position, biasing bearing 490 may be in the rest position because spring 420 is at its most extended state and therefore at its lowest potential energy. In FIG. 11, when foot board 320 is depressed, and drive shaft 340 rotates to the forward position, biasing bearing 490 rolls along biasing bearing surface 485 into the actuated position. When biasing bearing 490 is in the actuated position, spring 420 compresses and the spring tension increases. Upon release of foot board 320, the spring tension of compressed spring 420 forces biasing bearing 490 to roll back along biasing bearing surface 485 toward the rest position.

As shown in FIG. 12, after the foot board is released, biasing bearing 490 will roll along biasing bearing surface 485 toward the rest position. If biasing bearing 490 rolls past the rest position on biasing bearing surface 485, where spring 420 is most extended, then biasing bearing 490 will roll along biasing bearing surface 485 towards a retention position and compress spring 420 and increase spring tension. When biasing bearing 490 is in the retention position, the spring tension will cause biasing bearing 490 to roll back along biasing bearing surface 485 towards the rest position. The retention position ensures that biasing bearing 490 returns to the rest position, and biasing arm 480 returns to the ready position when the foot board is not depressed.

V. Drum Clamp Mounted in Bracket

As generally shown in FIGS. 13-17, in one embodiment, a drum pedal may have drumward clamp 600 including shaft 610 extending through shaft housing 611, rotatable arm 620, lever 630, torsion spring 650, and adjustable bracket 670. Clamp 600 may be attached to a drum pedal to hold and position the drum pedal behind a bass drum pedal. A drum pedal may have base 605 and may have drumward end 602.

Figure 13:
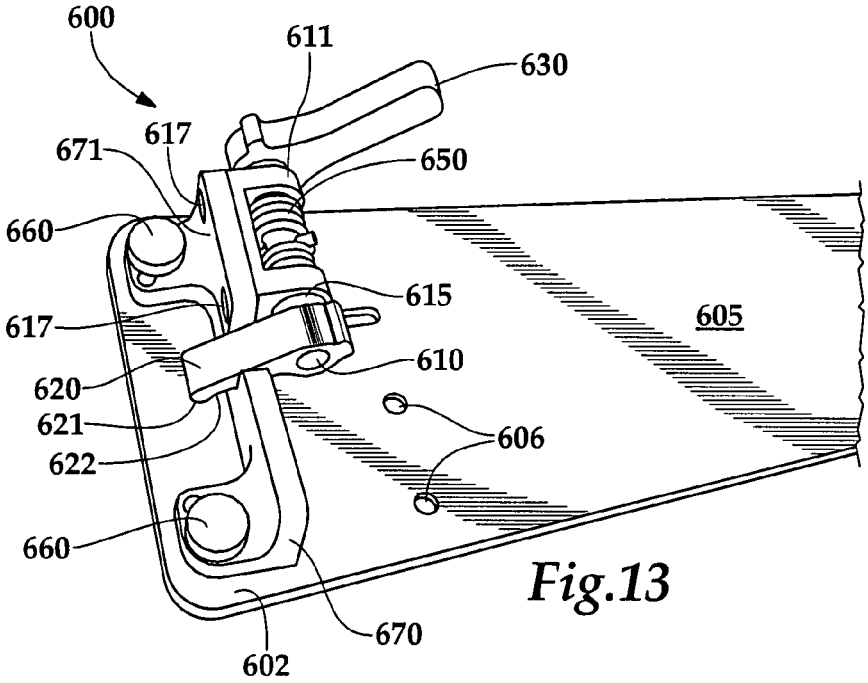
FIG. 13 is a perspective view of a drum pedal base with a clamp.
Figure 17:
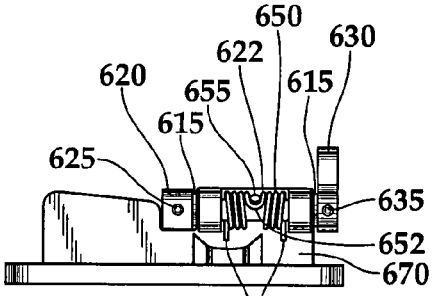
FIG. 17 is a reduced back view of a drum pedal base with a clamp.

As seen in FIG. 13, shaft 610 turns inside bushings 615 that may be integral with shaft housing 611. Shaft housing screws 617 hold shaft housing 611 securely to positioning bracket 670. As shown in FIG. 17, arm 620 is affixed to shaft 610 by arm screw 625. Lever 630 is connected to shaft 610 by lever screw 635. Bushings 615 encircle and prevent shaft 610 from shifting in shaft housing 611.

As seen in FIG. 17, in one embodiment, torsion spring 650 encircles shaft 610 between bushings 615. Torsion spring 650 may have stop legs 651 and stop loop 652. Torsion spring 650 may be compressed when stop legs 651 and stop loop 652 are pinched toward one another. In a preferred embodiment, stop legs 651 may push against positioning bracket 670, and stop loop 652 may push against stop pin 655 mounted to shaft 610. Torsion spring 650 biases stop pin 655 upwardly and biases arm 620 downwardly to engage with a drum rim.

Arm 620 may be positioned as shown in FIG. 13. Torsion spring 650 biases arm 620 into a locking position. Arm 620 may have rounded protrusion 621 with back surface 622 for contacting and securely locking to a drum rim and for keeping the drum from moving. Rubber pads 660 placed on drumward end 602 of base 605 help cushion a bass drum when the drum is in position to be played. The rubber pads 660 may be soft and moldable to the contacting surface of the bass drum.

Figure 14:
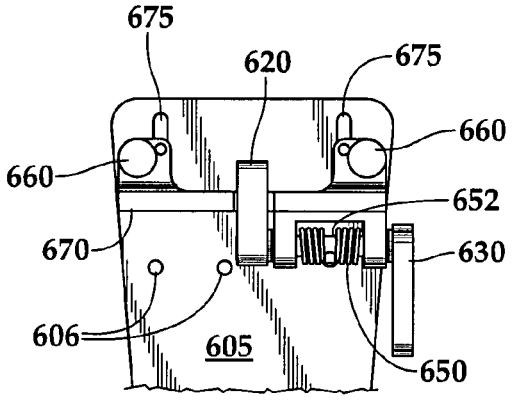
FIG. 14 is a reduced top view of a drum pedal base with a clamp.
Figure 15:
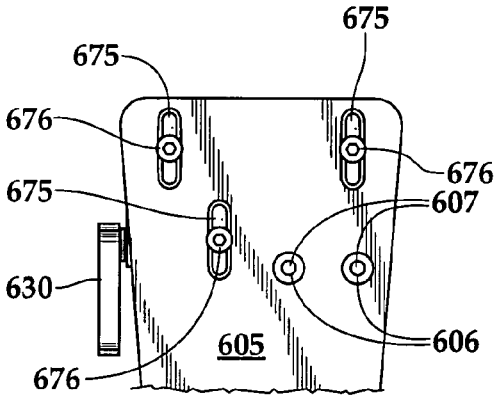
FIG. 15 is a reduced bottom view of a drum pedal base with a clamp.
Figure 16:
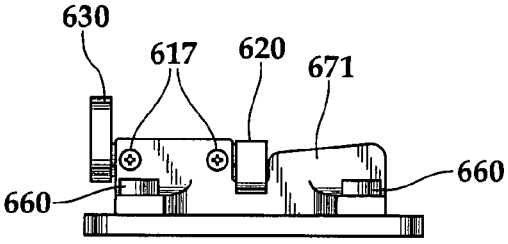
FIG. 16 is a reduced front view of a drum pedal base with a clamp.

As seen in FIGS. 13-15, a pedestal (not shown) may be securely mounted to base 605 using pedestal mounting holes 606 and pedestal mounting screws 607. Base 605 also has positioning bracket slots 675 allowing positioning bracket 670 to slide toward and away from drumward end 602. Positioning bracket slots 675 accommodate for different hoop depths of drums by allowing for positioning bracket 670 to be adjustably mounted at a minimum distance from the drum head surface. Preferably, positioning bracket 670 has a range of motion between about 0.3 inch and about 2.0 inch, more preferably between about 0.5 inch and 1.5 inch, and in the embodiment shown about 1.0 inch. After proper orientation, positioning bracket 670 may be secured to base 605 with positioning bracket screws 676.

As seen in FIG. 13, drum clamp 600 may be positioned in the locked position, which is the natural position due to biasing by torsion spring 650. To unlock drum clamp 600, pressure may be applied to lever 630 causing arm 620 to rotate. In one embodiment, unlocking drum clamp 600 involves torquing lever 630 away from drumward end 602. Lever 630 may be torqued between about 30 degrees and about 60 degrees away from drumward end 602, more preferably between about 40 degrees and 50 degrees away from drumward end 602, and in the embodiment shown about 45 degrees from drumward end, to achieve a maximum unlocked position. In the unlocked position, the rim of a drum may be placed under arm 620 on rubber pads 660. Stop surface 671 on positioning bracket 670 acts as a stop for a drum rim. Drum clamp 600 should be easy to operate because no tools are necessary to move lever 630. Hand strength may be sufficient to move lever 630 and unlock arm 620 from a drum rim.

VI. Link with Plurality of Positions

Figure 19:
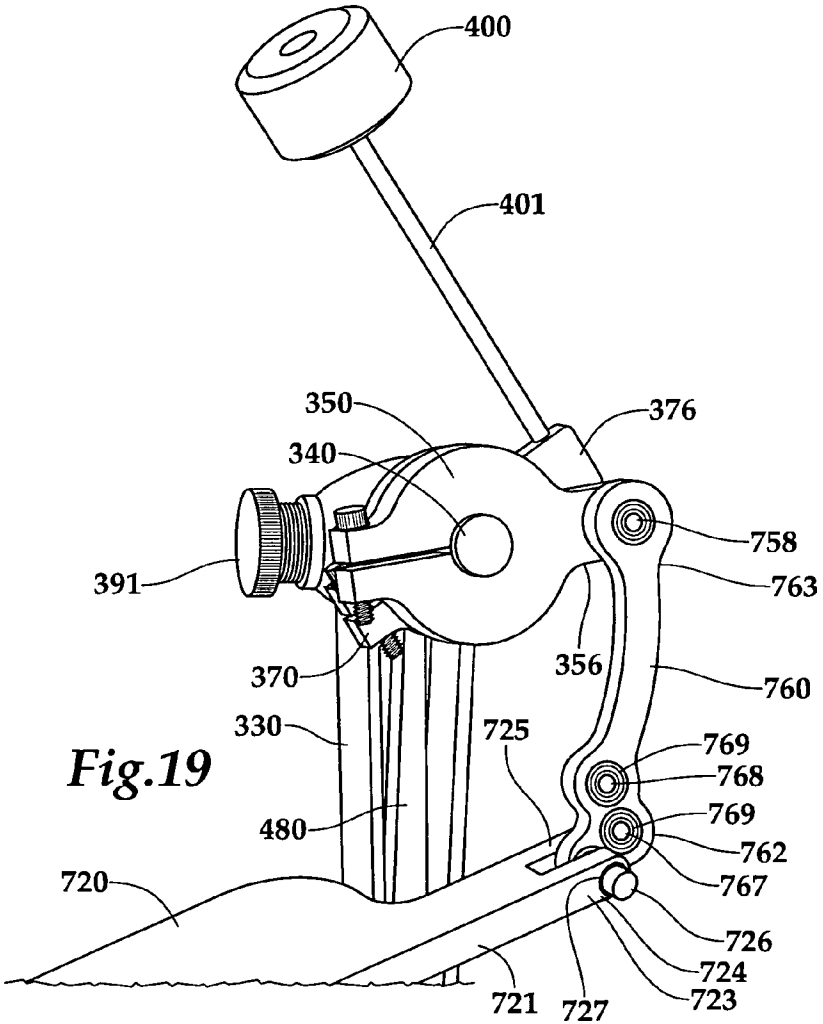
FIG. 19 is a perspective view of a link attached to a drive ring and a foot board.
Figure 18:
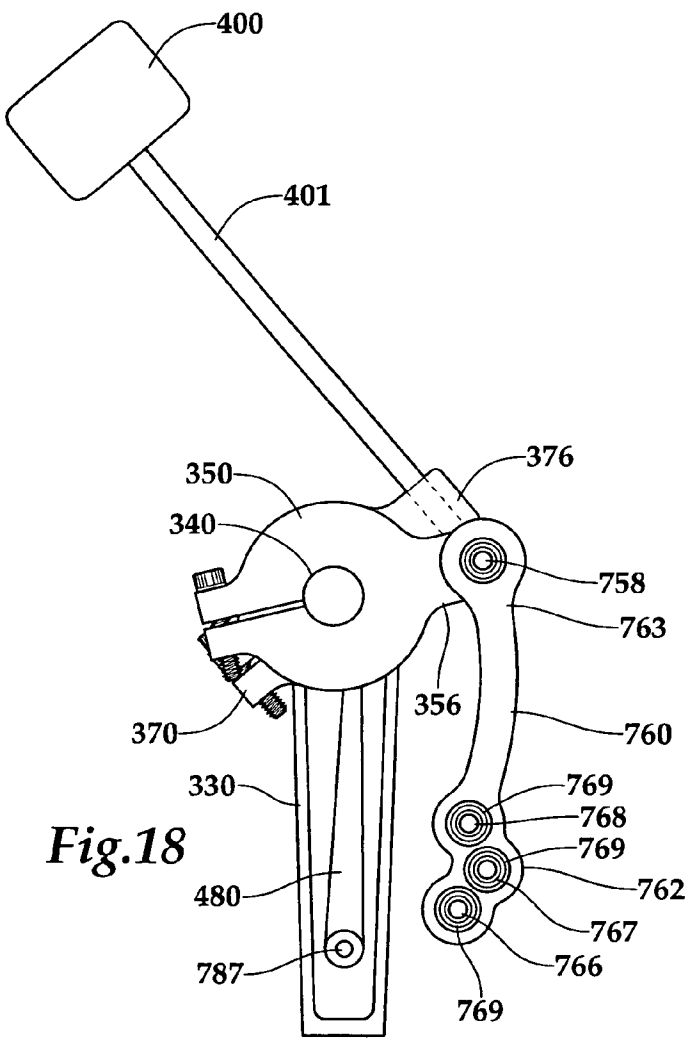
FIG. 18 is a side view of a link attached to a drive ring of a drum pedal.

As shown in FIGS. 18 and 19, a drum pedal may have an alternate form of link 760 operatively linking drive ring 350 to foot board 720, see FIG. 19. Drive ring 350 clamps around drive shaft 340. Link 760 may have toe portion 762 and drive portion 763 which may engage drive ring 350 at arm 356 by link pin 758. Toe portion 762 may have a plurality of positions for adjustably connecting to, and adjusting the height of toe end 721 of foot board 720.

As shown in FIG. 18, toe portion 762 of link 760 may have between one and about five positions, preferably between about two and about four positions, and in the embodiment shown about three positions. Positions may be defined by bearings 769 having open centers or holes 766, 767 and 768 for receiving foot board pin 726. Hole 766 may be the position furthest from drive portion 763. Hole 768 may be the position closest to drive portion 763. Hole 767 may be between hole 766 and hole 768 and may be offset from both hole 766 and hole 768. Bearings 769 may be positioned to enable pivoting in one of holes 766, 767, or 768 by foot board pin 726.

As shown in FIG. 19, foot board 720 may have toe end 721 which may have a U-shaped tip 723 that receives and engages toe portion 762. U-shaped tip 723 may comprise parallel legs 724 and 725. Foot board pin 726 may fit in foot board toe hole 727 of leg 724, one of holes 766, 767, or 768 and a hole or bore in leg 725. Toe portion 762 fits between leg 724 and leg 725 such that one of holes 766, 767, or 768 lines up with foot board toe hole 727.

Toe end 721 of foot board 720 may be raised and lowered in height by lining up one of holes 766, 767, or 768 with foot board toe hole 727 and positioning foot board pin 726 through both holes and in a hole or dimple in leg 725. Positioning foot board pin 726 in hole 766 places foot board 720 in the lowest position because link 760 is longest. Positioning foot board pin 726 in hole 768 places foot board 720 in the highest position because link 760 is shortest. Placing foot board pin 726 in hole 767 places foot board 720 in an intermediate position. Having three height options for foot board 720 allows each drummer to find a comfortable position.

As shown generally in FIGS. 9-19, in summary of biasing arm embodiment 310, a drum pedal may have base 305, foot board 320, pedestal 330 with a longitudinal axis, drive assembly 345 supported by pedestal 330 having journaled drive shaft 340, rotatatable bearing 490 mounted off center of drive shaft 340, spring 420, biasing arm 480 pivotally mounted on pedestal 330, wherein bearing 490 and spring 420 cooperate to bias biasing arm 480 toward predetermined rest position 481, a linkage operatively connecting foot board 320 to drive shaft 340, beater 400 operatively connected to drive shaft 340, wherein bearing 390 displaces biasing arm 480 and compresses spring 420 when foot board 320 is depressed. Drum pedal 310 may also have tension adjuster 390 for spring 420, wherein tension adjuster 390 forms an angle between about 30 degrees and about 150 degrees with respect to the longitudinal axis of pedestal 330. Beater 400 may have stem 401 operatively connected to drive assembly 345 and may be actuated to a forward position when foot board 320 is depressed and to a rearward position when foot board 320 is not depressed. Drum pedal 310 may have a ready position wherein biasing arm 480 is in a rest position, beater 400 is in a rearward position, and foot board 320 is in a raised position. Biasing arm 480 may be in the actuated position when foot board 320 is depressed and beater 400 is in the forward position.

A drum pedal may have base 305, foot board 320, pedestal 330 with an axis extending upwardly from base 305, drive assembly 345 supported by pedestal 330 having journaled drive shaft 340, and a linkage operatively connecting foot board 320 to drive shaft 340, wherein the linkage includes an elongate link 760 having toe portion 762 and drive portion 763, wherein toe portion 762 has means for selectively defining a connection to the foot board from one of a plurality of positions. The plurality of positions may be between one and about five positions. The means may be bearings 769 having open centers for receiving foot board pin 726.

A drum pedal may have base 605 having drumward end 602, a moveable foot board situated above base 605, a beater operatively connected to the foot board and actuated thereby, bracket 670 mountable to drumward end 602, and clamp 600 operatively connected to bracket 670, having shaft 610, rotatable arm 620 mounted to shaft 610, torsion spring 650 mounted around shaft 610 and biasing arm 620 to lock with a drum rim, and lever 630 operatively connectable to shaft 610 rotatable to unlock arm 620 from the drum rim. Arm 620 may have stop loop 652 for engaging spring 650 and may have protrusion 621 for locking to the drum rim. Drumward end 602 may have a gripping surface generally opposite arm 620. Bracket 670 relative to drumward end 602 may be adjustable along a range of positions, between about 0.3 inches and about 2 inches.

VII. Universal Joint

Figure 21:
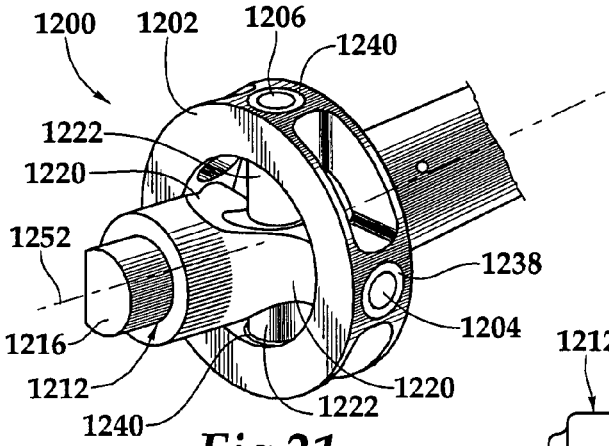
FIG. 21 is a perspective view of a universal joint connecting a pair of yokes.
Figure 22:
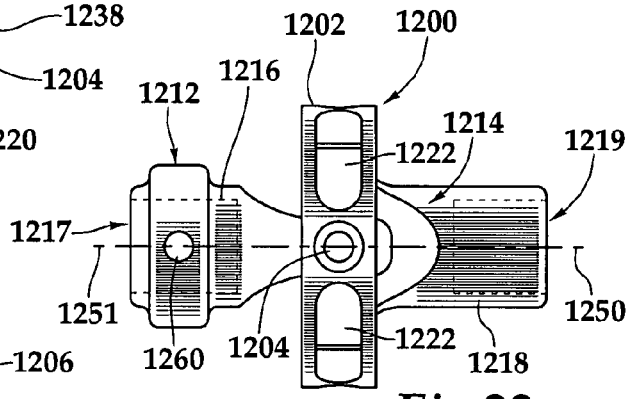
FIG. 22 is a side view another embodiment of a universal joint connecting a pair of yokes.

FIGS. 21 & 22 show a universal joint 1200 having a spider 1202 with two pairs of trunnions 1204, 1206, each pair of trunnions 1204, 1206 having an axis 1208, 1210. The universal joint 1200 further has a pair of yokes 1212, 1214 that may be generally normally aligned. Each yoke 1212, 1214 has a shaft 1216, 1218 and a pair of bosses 1220, 1222, and the shafts 1216, 1218 of the yokes 1212, 1214 may extend away from the external housing, or spider 1202, in generally opposite directions. Each pair of bosses 1220, 1222 receives a corresponding one of said pairs of trunnions 1204, 1206. While the positioning of each of the axes 1208, 1210 of the trunnions 1204, 1206 may vary, preferably the axes are substantially normal to one another.

The trunnions 1204, 1206 may be any structure that may rotatably connect the bosses 1220, 1222 to the spider 1202. For example, the trunnions 1204, 1206 may be pins, pivots, rods, shafts, posts, or balls. A pair of trunnions 1204, 1206 may be provided in the form of a pair of pins or alternatively a pair of trunnions 1204, 1206 may be provided in the form of spaced regions of a single pin. If trunnions 1204, 1206 are pairs of pins, trunnions 1204, 1206 may be spaced from each other at a point between arms of bosses 1220, 1222. Trunnions 1204, 1206 may be spaced between about 0 inches and about ⅜ inch, preferably between about ⅛ inch and about ⅜ inch, still more preferably between about ¼ inch and about ⅜ inch. Trunnions 1204, 1206 may also be coated with a lubricating substance that may reduce friction in the event a trunnion 1204 operatively connected to one yoke 1212 contacts a trunnion 1206 operatively connected to second yoke 1214.

Each yoke 1212, 1214 of the universal joint 1200 may be rotatably attached to the spider 1202 so that each yoke 1212, 1214 may rotate about a corresponding axis 1208, 1210 of one of the pairs of trunnions 1204, 1206. For example, in the embodiments shown in FIGS. 21 & 22, each yoke 1212, 1214 engages a pair of pins 1204, 1206 and is rotatable about the axis 1208, 1210 of the pair of pins 1204, 1206. While the size and the shape of each yoke 1212, 1214 may vary, each yoke 1212, 1214 preferably has a pair of bosses 1220, 1222, or arms, for engaging the distal parts 1224, 1226 of the trunnions 1204, 1206. The shape of the bosses 1220, 1222 may vary, but preferably each pair of bosses 1220, 1222 is generally U-shaped, creating a void between arms of one boss 1220 that allows yoke 1212 to rotate to a point proximate spider 1202 generally without contacting other yoke 1214, and vice-versa. Each arm 1220, 1222 may have an arm hole (not shown) for engaging a respective trunnion 1204, 1206 that aligns along the respective axis 1208, 1210 so that the first yoke 1212 is rotatable about the first axis 1208 and second yoke 1214 is rotatable about the second axis 1210.

Figure 23:
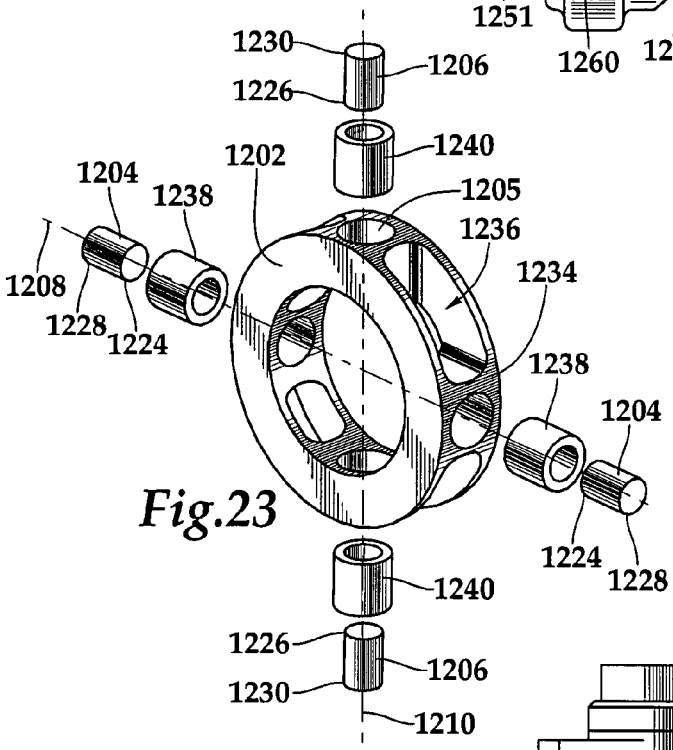
FIG. 23 is an exploded view of one embodiment of a universal joint.

In the exploded view shown in FIG. 23, the spider 1202 is a unitary, ring-shaped structure and has an inner surface forming a radially interior space 1232. Spider 1202 may also have a plurality of openings 1236 extending from a radially inner surface to a radially outer surface 1234. Plurality of openings 1236 may make spider 1202 lighter than if it were a solid block of material, thereby improving performance of the spider 1202 and universal joint 1200 by positively affecting the inertial or torsional properties of spider 1202. The dimensions of the ring-shaped spider 1202 may vary, but preferably the spider 1202 has an outer diameter of between about 1½ inches and about 2 inches, and more preferably about 1¾ inches, an inner diameter of between about 1 inch and about 1½ inches, and more preferably about 1⅛ inches. The spider 1202 preferably has a thickness between about ¼ inch and about ¾ inch, and more preferably about inch. The spider 1202 may be made of any suitable material, but it is preferably made of metal such as steel or aluminum.

For each pair of trunnions 1204, 1206, the spacing between distal proximal parts 1228, 1230 of each trunnion 1204, 1206 may vary depending on the intended use of the universal joint 1200. For example, for use in a drum pedal assembly 1300, for each pair of trunnions 1204, 1206, the preferable spacing is from about ¾ inch to about 1¾, more preferably from about ¾ inch to about 1½ inch between proximal parts 1228, 1230 of the trunnions 1204, 1206. There may also be a gap between distal parts 1224, 1226 of each pair of trunnions 1204, 1206. Gap may preferably be between about 0 inches and about ½ inch, more preferably between about 1/16 inch and about ¼ inch. However, gap may also be more than about inch.

The axes 1208, 1210 of each pair of trunnions 1204, 1206 in a universal joint 1200 are preferably proximate to a plane, i.e., in the context of a double drum pedal, the axes 1208, 1210 of the trunnions 1204, 1206 preferably are spaced no more than ¼ inch from a plane, and more preferably the axes 1208, 1210 of the trunnions 1204, 1206 are substantially coplanar.

In the embodiments shown in FIGS. 21-23, the trunnions 1204, 1206 may be pins. Pins 1204, 1206 may be integral with the spider 1202 or, preferably, pins 1204, 1206 may be inserted into the spider 1202 and rotatable therein. More preferably, a portion of each pin 1204, 1206, preferably including proximal ends 1228, 1230 of pins 1204, 1206 may be housed in bushing or bearings 1238, 1240, which may be roller ball bearings in cages, but more preferably needle roller bearing sub assemblies.

Staying with FIGS. 21-23, the universal joint 1200 has four pins (two pairs) 1204, 1206 that are sized to fit within holes 1203, 1205 in the external housing 1202 so that the pins 1204, 1206 may be capable of rotating within the holes 1203, 1205. The size of the pins 1204, 1206 may vary, but preferably each pin 1204, 1206 is generally cylindrical and has a length between about ½ inch and about 1 inch, and more preferably about ¾ inch, and a diameter between about 0.1 inch and 0.3 inch, and more preferably about 0.2 inch. Preferably, the pins 1204, 1206 are arranged so that a first pair of pins 1204 is aligned along the first axis 1208 and a second pair of pins 1206 is aligned along the second axis 1210. The angle between the first axis 1208 and the second axis 1210 may vary, but preferably first axis 1208 and second axis 1210 are substantially perpendicular to each other. The pins 1204, 1206 may be made of any suitable material, but they are preferably made from heat-treated stainless steel. While the positioning of the pins 1204, 1206 may vary, it is preferred that the pins 1204, 1206 are positioned so that the distal parts 1224, 1226 of the pins 1204, 1206 extend into the interior space 1232 of the spider 1202 and the proximal ends 1228, 1230 may be generally flush with an exterior surface 1234 of the spider 1202.

To enhance the ability of the pins 1204, 1206 to rotate, the holes 1203, 1205 may be fitted with bushings or bearings 1238, 1240. As with the trunnions 1204, 1206, there may be two pairs of bearings 1238, 1240, each pair of bearings 1238, 1240 having an axis 1208, 1210. Preferably, the axes 1208, 1210 of the pairs of bearings 1238, 1240 are generally coplanar. Each of the bearings 1238, 1240 may be configured to receive the proximal part 1228, 1230 of a corresponding trunnion 1204, 1206. While the bearings 1238, 1240 may be secured in the holes 1203, 1205 by a variety of ways, it is preferred that the bearings 1238, 1240 are secured by press fit. A variety of different types of bearings 1238, 1240 may be used, but preferably the bearings 1238, 1240 are roller bearings, and more preferably the bearings 1238, 1240 are SCE36TN model needle roller bearings.

Trunnions 1204, 1206 may be designed to have a specific, predetermined clearance with bearings 1238, 1240. Surprisingly, however, in order to enhance the anti-backlash feature of the universal joint 1200, trunnions 1204, 1206 may be sized so as to produce an interference fit with bearings 1238, 1240. For example, proximal parts 1228, 1230 of trunnions 1204, 1206 may be sized slightly larger than an interior surface of bearings 1238, 1240. If trunnions 1204, 1206 are generally cylindrical and interior surface of bearings 1238, 1240 are generally cylindrical, this may be accomplished by making the diameter of proximal parts 1228, 1230 of trunnions 1204, 1206 slightly larger than the diameter of interior surfaces of bearings 1238, 1240. In order to prevent binding of trunnions 1204, 1206 within bearings 1238, 1240, it may be necessary to take advantage of the elastic nature of bearing housings, which may be designed to flex by either collapsing or expanding slightly under either a compressive or tensile load, respectively. This may be accomplished by designing holes 1203, 1205 of spider 1202 to have a diameter about equal to or slightly larger than an outer diameter of bearing housings, i.e. of the bearing outer race diameter. This design, coupled with proximal parts 1228, 1230 of trunnions 1204, 1206 being sized slightly larger than the diameter of the interior surface of bearings 1238, 1240 may allow bearings 1238, 1240 to expand slightly and press against the walls of the holes 1203, 1205 of the spider. The design may also cause a constant pressure, load and/or tension to be applied through bearing housing, bearings 1238, 1240 and onto trunnions 1204, 1206, enabling trunnions 1204, 1206 to rotate in bearings 1238, 1240, while reducing or eliminating backlash caused by clearances between trunnions 1204, 1206 and bearings 1238, 1240.

In another embodiment, holes 1203, 1205 of spider 1202 may be slightly smaller than an outer raceway or outer diameter of bearings 1238, 1240. Inserting bearings 1238, 1240 into holes 1203, 1205 may then slightly collapse or compress races of bearings 1238, 1240, causing an inner diameter of bearings 1238, 1240 to shrink, thereby creating an interference fit between bearings 1238, 1240 and proximal parts 1228, 1230 of trunnions 1204, 1206. This interference fit may then cause a pressure to be gently applied to the pivot pins or trunnions 1204, 1206 through the needles of the bearings 1238, 1240. This may, therefore, allow for subtle yet generally constant compression of trunnions 1204, 1206, eliminating undesirable play or backlash.

In still another embodiment, components of the two designs described above may be employed. Trunnions 1204, 1206 may be sized slightly larger than the inner diameter of bearings 1238, 1240, and holes 1203, 1205 of spider may have a diameter about equal to or slightly smaller than the outer diameter of bearings 1238, 1240. The combination of these features may create a compressive fit between spider 1202, bearings 1238, 1240 and trunnions 1204, 1206, reducing or eliminating backlash in the universal joint 1200.

An interference fit may be particularly useful when the yokes 1216, 1218 are designed to pivot at small angles and move at low speeds. In one embodiment, interference fit may be between about 0 inches and about 4/10,000 inches, preferably between about 0 inches and about 3/10,000 inches, still more preferably between about 1/10,000 inches and about 3/10,000 inches.

In contrast to using bearings 1238, 1240, other methods may be used to facilitate rotation of trunnions 1204, 1206 with respect to spider 1202. In another embodiment, bushings may be located between each of trunnions 1204, 1206 and spider 1202. Preferably, bushings may be made of bronze or of a polymer material such as polytetrafluoroethylene (PTFE), or TEFLON, to reduce friction between bearings 1238, 1240 and trunnions 1204, 1206. In this case, generally similarly precise machining, design and quality control used to manufacture bearings 1238, 1240 may be applied to produce a more economical universal joint assembly 1200. Moreover, additional methods of producing an interference fit while still allowing for rotation of trunnions 1204, 1206 are within the scope of this invention.

In the embodiments of FIGS. 21 & 22, the distal parts 1224, 1226 of the trunnions 1204, 1206 extend into the interior space 1232 and the bosses 1220, 1222 receive the distal parts 1224, 1226 of the trunnions 1204, 1206 in the interior space 1232. The dimensions of the yokes 1212, 1214 shown in FIGS. 21 & 22 may vary, but preferably each yoke 1212, 1214 has an overall length of between about 1 inch and about 2 inches, and more preferably about 1½ inches. Each arm 1220, 1222 of the yokes 1212, 1214 preferably has a length of between about ¼ inch and about ¾ inch, and more preferably about ½ inch. The distance between the arms 1220, 1222 of each yoke 1212, 1214 is between about 0.2 inch and about 0.5 inch, and more preferably about 0.35 inch. The yokes 1212, 1214 may be made of any suitable material, but preferably they are made from aluminum.

The yokes 1212, 1214 fit within small tolerances with respect to the spider 1202. The tolerances may be selected to allow generally free rotation between yokes 1212, 1214 and spider 1202 but tight enough to prevent substantial lateral movement of the yokes 1212, 1214 with respect to the spider 1202. In the embodiments shown in FIGS. 21 & 22, the clearance between yoke and spider may be between about 0 inches and about ⅛ inch, preferably between about 1/32 and about 3/32 inch, still more preferably about 1/16 inch.

The spider 1202, or collar, bearings 1238, 1240 and pins 1204, 1206 are configured so that connectors such as bosses 1220, 1222 may engage the pins 1204, 1206 in the interior space 1232 of the collar 1202. Interior space 1232 may be sized slightly larger than an outer width of yokes 1212, 1214 so that a small portion of trunnions 1204, 1208 or bearings 1238, 1240, or both may fill the gap between spider 1202 and yokes 1212, 1214. Configuring universal joint 1200 so that engagement occurs in the interior space 1232 of the collar 1202 may reduce the moment of inertia of universal joint 1200, which may allow universal joint 1200 to rotate more easily and transfer energy from one yoke 1212 to another yoke 1214 more efficiently. One connector 1220 may engage the two pins 1204 that lie along the first axis 1208 of the collar 1202, and the other connector 1222 may engage the two pins 1206 that lie along the second axis 1210 of the collar 1202. Accordingly, the first connector 1220 may rotate about the first axis 1208 and the second connector 1222 may rotate about the second axis 1210.

VIII. Drum Pedal Assembly

Figure 20:
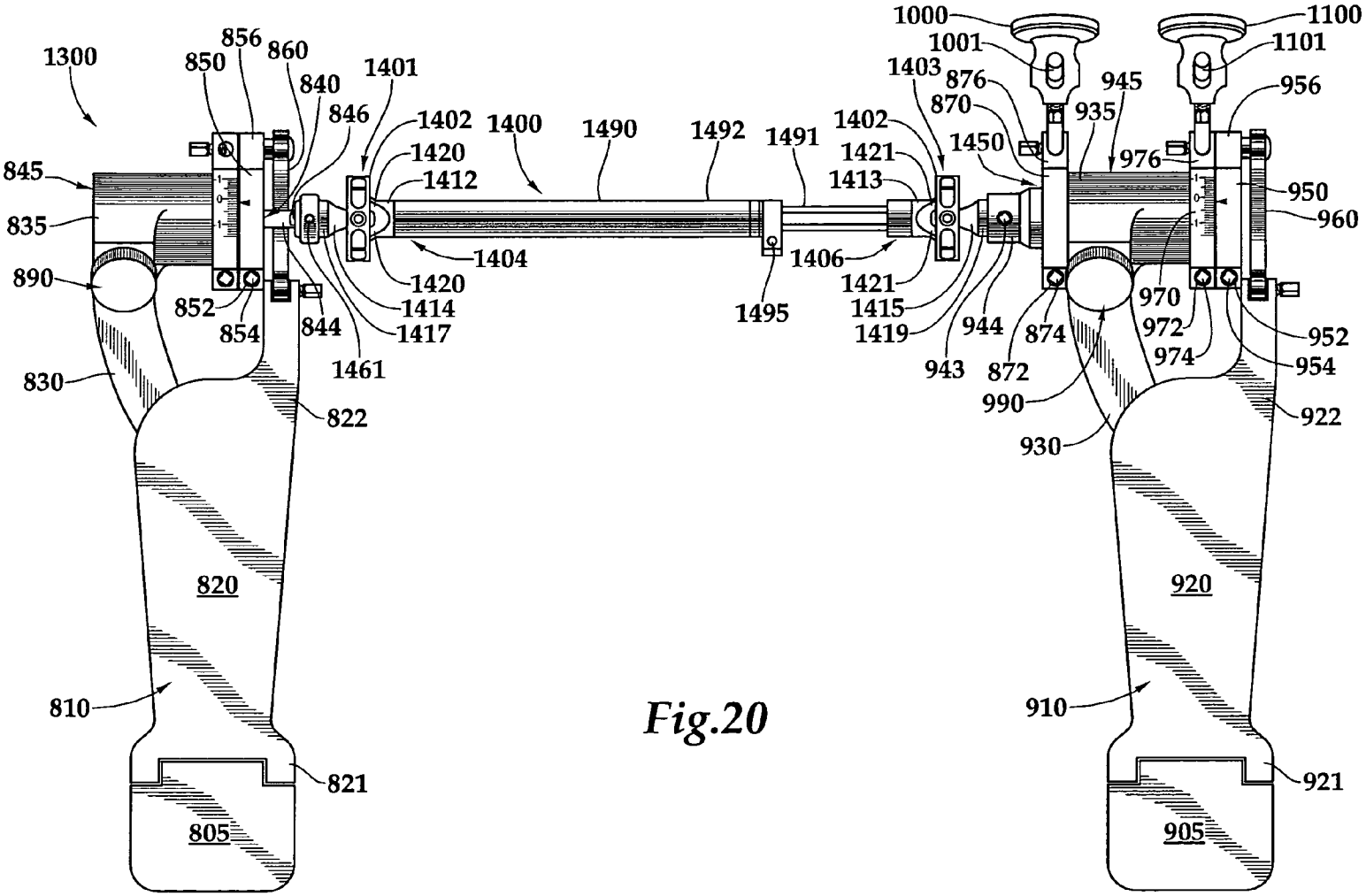
FIG. 20 is a perspective view of one embodiment of a double-drum pedal assembly.

In another aspect of the invention, a drum pedal 810 may be connected to a linkage 1400 to remotely actuate a beater 1000. For example, as shown in the embodiment of FIG. 20, a drum pedal assembly 1300 may comprise a drum pedal 810 having a base 805 with a pedestal 830, a drive assembly 845 supported by said pedestal 830, and a foot board 820 operatively connected to said drive assembly 845. The assembly 1300 may also include a linkage 1400 comprising a transmission shaft 1490 having a pair of yokes 1412, 1413, one at each end 1404, 1406, each yoke 1412, 1413 having a shaft 1416, 1418 (not shown) and a pair of bosses 1420, 1421, each of said yokes 1412, 1413 connecting into a universal joint 1401, 1403. Yokes 1412, 1413 may be separate pieces that are attached to ends of shaft 1490 and may be press fit, pinned into place, screwed in or fastened to ends of shaft in any other manner generally known in the art. In one embodiment, as exemplified by the yoke 1214 of FIG. 22, yoke shaft 1218 may have an axis 1250 and a generally axial opening 1219 for receiving an end 1406 of transmission shaft 1490. In another embodiment, transmission shaft 1490 may have an axis (not shown) and a generally axial opening (not shown) for receiving yoke shaft 1216, such as the yoke shaft 1216 shown in the embodiment of FIG. 21. Alternatively, each yoke shaft 1214, 1216 and its respective transmission shaft end 1406, 1404 may be machined or fabricated from a single piece of material. In one embodiment, the yoke 1412 at one end 1404 of the transmission shaft 1490 may be oriented generally parallel to the yoke 1413 at the other end 1406 of the transmission shaft 1490. However, the pair of yokes 1412, 1413 may be oriented at an offset angle relative to one another.

Similar to the embodiments of FIGS. 21 & 22, each universal joint 1401, 1403 may have another, second yoke 1414, 1415 extending away therefrom, each second yoke 1414, 1415 having a shaft 1417, 1419 and a pair of bosses 1422, 1423 (not shown), one of said second yokes 1414 extending away from one universal joint 1401 being operatively connected to said drive assembly 845 and the other of said second yokes 1415 extending away from the other universal joint 1403 being operatively connected to a support 930. As shown in the embodiments of FIGS. 21 & 22 and the exploded view of FIG. 23, each universal joint 1401, 1403 is like universal joint 1200 described above and has a spider 1202 having two pairs of trunnions 1204, 1206, each pair of trunnions 1204, 1206 having an axis 1208, 1210, each one of said trunnions 1204, 1206 having a part proximal 1228, 1230 to said spider 1202 and a distal part 1224, 1226 extending from said spider 1202. For each universal joint 1401, 1403, each pair of bosses 1420 & 1421, 1422 & 1423, respectively, receives said distal parts 1224, 1226 of a corresponding pair of trunnions 1204, 1206. For each pair of trunnions 1204, 1206, the spacing between proximal parts 1228, 1230 may be from about ¾ inch to about ½ inch. The assembly further includes a beater 1000 operatively connected to an end 1450 of said linkage 1400 that is proximal to said support 930, wherein pressing said foot board 820 of said pedal 810 rotates said linkage 1400 and actuates said beater 1000. Use of universal joints 1401, 1403 as described above, including inverted design and/or spacing between distal parts 1224, 1226 of trunnions 1204, 1206 may help to reduce, and preferably eliminate, backlash or vibration in assembly.

For each universal joint 1401, 1403, the shafts 1416 & 1417, 1418 & 1419, respectively, of the yokes 1412 & 1414, 1413 & 1415, respectively, extend in generally opposite directions away from the spider 1402. When the apparatus is set up for use, the axes 1208, 1210 of the yoke shafts 1416 & 1417, 1418 & 1419, respectively, for each universal joint 1401, 1403 preferably form as close to a straight line as possible, consistent with the comfort of the user. However, each universal joint 1401, 1403 may allow for the axes 1208, 1210 to deviate by between about 0 degrees and about 40 degrees. For each universal joint 1401, 1403, bosses 1420 & 1422, 1421 & 1423 on first yokes 1412, 1413 and second yokes 1414, 1415 may be generally perpendicular to one another. While adjustable, as shown in FIG. 20, bosses 1420, 1421 on first yokes 1412, 1413 on opposite ends 1404, 1406 of transmission shaft 1490 may be generally parallel. Moreover, bosses 1422 on one of second yokes 1414 may be generally parallel to bosses 1423 on another of second yokes 1415.

Preferably, the support 930 is another, second pedal 910, as shown in FIG. 20. However, support 930 may be any structure that may support the end 1450 of the linkage 1400 opposite the first pedal 810. For example, the support 930 may be a pedestal, a pole or any suitable structure capable of supporting the linkage 1400.

In the embodiment of FIG. 20, the linkage 1400 may be releasably attached to the pedals 810, 910. For example, the drive assembly 835 of the first pedal 810 may have an extended shaft 844 that protrudes from the drive assembly 835. Extended shaft 844 may be part of a drive shaft 840 that rotates when first pedal 810, which may be attached to a drive ring 850 that is attached to drive shaft 840, is depressed. In another embodiment, extended shaft 844 may be a part of drive ring 850 and rotate when drive ring 850 rotates. The size and shape of the protrusion may vary, but preferably the extended shaft 844 has a length between about ½ inch and about 2 inches, and more preferably about ¾ inch.

The extended shaft 844 may be configured to receive the shaft 1417 of a second yoke 1414 from the linkage 1400. The shaft protrusion 844 may be generally cylindrical and the shaft 1417 of the second yoke 1414 may have a generally tube-shaped opening 1217, generally aligned with the shaft axis 1251, similar to the yoke 1212 of FIG. 22, to receive the shaft protrusion 844. The shaft protrusion 844 may be secured within the second yoke 1414 by any suitable means. As seen in FIG. 22, the shaft 1216 of the yoke 1212 may have a second opening 1260 or a hole generally normal to the shaft axis 1251. The hole 1260 may be threaded to accommodate a fastener 1461, such as a screw, that may be inserted until it contacts the extended shaft 844 and then tightened to secure the shaft protrusion 844 within the yoke 1414. Preferably, the shaft protrusion 844 has a flat surface 846 that aligns with the hole 1260 to increase the surface area with which fastener 1461 can contact, increasing the holding strength of the screw 1461. Accordingly, when the pedal 810 is pressed, the shaft 840 of the drive assembly 845 may rotate and cause the linkage 1400 to rotate.

Figure 25:
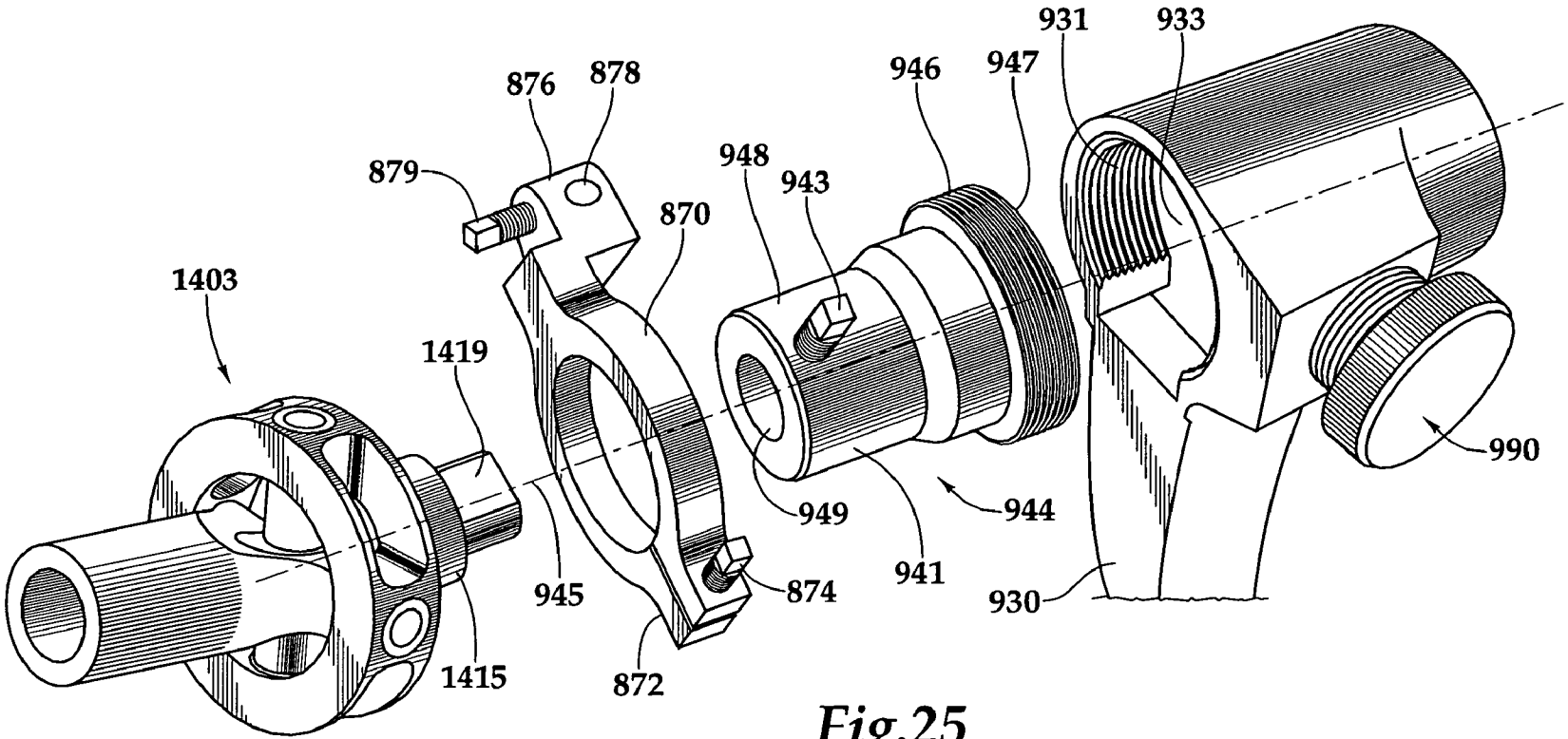
FIG. 25 is an exploded view of a universal joint, beater ring and attachment arbor operatively connecting to a second pedal.

The other end 1450 of the linkage 1400 may also be releasably attached to the support 930, which in the embodiment of FIG. 20 is another pedal 910. As can be seen in the exploded view of FIG. 25, this pedal 910 may have a support 930 having an attachment arbor 944 removably attached to it. Support 930 may have internal threading 931, which may align with external threading 946 on an end 947 of attachment arbor 944 in order to operationally connect attachment arbor 944 to support 930. However, attachment arbor 944 may be connected in any other manner that allows attachment arbor 944 to rotate with respect to support 930, including having bearings (not shown) between attachment arbor 944 and support 930 to facilitate rotation. Attachment arbor 944 may comprise an extension 941 having an axis 945 extending in a generally opposite direction from the end 947 carrying external threading 946, and extension 941 may have a generally axial opening 949.

The generally axial opening 949 of attachment arbor 944 is configured to receive the shaft 1419 of a second yoke 1415 connected to a universal linkage 1403 at the other end 1450 of the linkage 1400 from that discussed above. For example, the axial opening 949 may be generally tube shaped to receive the shaft 1419 of the second yoke 1415, which may be generally cylindrical. Like extension shaft 844 on the first pedal 810, the shaft 1419 of the second yoke 1415 may have a generally flat surface (not shown) that intersects with a second opening 942 (not shown) in the extension 941, where the second opening 942 may be generally normal to the axial opening 949. The hole 941 may house a fastener 943 that may be tightened with a key to secure the shaft 1419 of the yoke 1415 within the attachment arbor 944. As seen in FIG. 20, fastener 1461 for securing shaft protrusion 844 to second yoke 1414 proximate first pedal 810 and fastener 943 for securing shaft 1419 of yoke 1415 within the attachment arbor 944 proximate second pedal 910 may be generally parallel and may be located circumferentially on second yoke 1414 and attachment arbor 944 so as to be easily reachable and adjustable by a drummer using the assembly. Accordingly, when the remote pedal 810 is pressed, causing the linkage 1400 to rotate, the attachment arbor 944 rotates.

The attachment arbor 944 may be configured to receive a beater ring 870. Beater ring 870 may have an arm 876 that may in turn hold a drum beater 1000 through means described above. The beater ring 870 may be releasably attachable to the housing of attachment arbor 944 using any suitable means. Preferably, the beater ring 870 may have a beater clamp protrusion 872 generally opposite arm 876, and a beater clamp screw 874 may be used to tighten beater clamp protrusion 872, securing beater ring 870 to attachment arbor 944.

While the use of a beater ring 870 attached to the housing 944 is preferred, the beater 870 may be attached in a variety of ways so long as the linkage 1400 actuates the beater 1000 when the pedal 810 is pressed. For example, the beater 1000 may be attached directly to the shaft 1419 of the second yoke 1415 extending from the universal joint 1403, or the beater 1000 may be attached directly to the attachment arbor 944.

Pedal 910 may also include a faceplate (not shown) that is releasably attached. For example, the face plate may be threaded so that it may be screwed into internal threading 931 of an opening 933 in the pedestal 930 configured for receiving the attachment arbor 944. Such a configuration may allow for the user to exchange the attachment arbor 944 having an extension 941 with the beater ring 970 for one without an attachment arbor 944 in situations where the user may prefer to use the pedal 910 without the linkage 1400 and cover the opening 933 with a faceplate.

As shown in FIG. 20, linkage 1400 has a transmission shaft 1490, which may be adjustable in length. The overall length of the shaft 1490 may be between about 6 inches and about 24 inches. Preferably, shaft 1490 is telescoping and is adjustable, having a shortest length of between about 6 inches and about 12 inches and an extended length of between about 12 inches and about 24 inches. Each piece of the shaft may be between about 6 inches and about 12 inches, and two or more telescoping sections may be employed.

In one embodiment, the shaft 1490 may be comprised of an inner portion 1491 and an outer portion 1492, which allows the length of shaft 1490 to be adjustable. More specifically, inner portion 1491 may be shaped to fit within outer portion 1492, which may be tube-like. In this sense, the shaft may be telescoping. While the shape of the inner portion 1491 may vary, in the embodiment shown in FIG. 20, it has a hexagonal cross section. Inner section 1491 may be proximate first pedal 810 and outer section 1492 proximate support 930. However, in the embodiment of FIG. 20, transmission shaft 1490 is configured so that outer section 1492 is proximate first pedal 810 and inner section 1491 is proximate support 930.

Figure 24A:
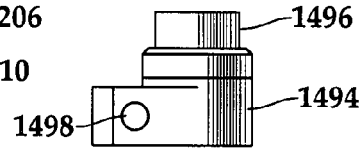
FIG. 24A is front view of a clamp for operatively connecting sections of a transmission shaft.
Figure 24C:
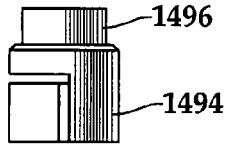
FIG. 24C is a side view of the clamp of FIG. 24A.
Figure 24B:
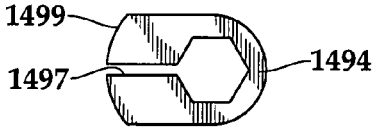
FIG. 24B is a top view of the clamp of FIG. 24A.

Inner portion 1491 may be releasably secured to outer portion 1492 so that the length of transmission shaft 1490 may be adjustable but remains substantially the same when assembly 1300 is in use. In one embodiment, the outer portion 1492 may be configured with a clamp 1494 and a fastener 1495 to secure inner portion 1491 within the outer portion 1492. Clamp 1494 may be fabricated or machined from same piece of material as outer portion 1492. Alternatively, as shown in the embodiment of FIGS. 24A-24C, clamp 1494 may be a separate component having a reduced cross-section area 1496 that may be press fit into outer portion. Clamp 1494 may have a slit 1497 along one end 1499 and an opening 1498 for fastener 1495 running generally perpendicular to slit 1497, such that tightening fastener 1495 reduces the size of slit 1497, securing inner portion 1491 of transmission shaft 1490 to outer portion 1492. In another embodiment, outer portion 1492 may be threaded and have a tapered section. Inner portion 1491 may be secured within outer portion 1492 by rotating a nut along threads toward tapered section, decreasing size of tapered section to create an interference fit between inner 1491 and outer portions 1492. In either embodiment, clamp 1494 and fastener 1495 or nut may be configured so as to be visible to a user or be easily accessible and adjustable by a user while in use.

Assembly 1300 may be configured so that substantially similar pedals 810, 910 may be used interchangeably. Pedals 810, 910 may be designed to operate in a master-slave relationship whereby depressing foot board 820 on pedal 810 may cause beater 1100 driven by pedal 910 to strike drum surface. Preferably, pedals 810, 910 operate independently, with each pedal operatively connected to its own drive assembly 845, 945 and its own beater 1000, 1100. In this way, and similar to the single pedal embodiments described above, each drive ring 850, 950 and each beater ring 870, 970 may be separately, independently rotationally adjustable with respect to drive assemblies 845, 945. This may allow a user to adjust each beater 1000, 1100 to behave similarly or differently, depending on the user's preferences. It also enables multiple beaters 1000, 1100 to strike drum surface at one time, or may allow for shorter intervals between strikes, or strikes with greater intensity at short intervals than may be possible under a master-slave relationship.

As with each of the pedal designs described above, pedals 810, 910 of assembly 1300 may each include at least one drive ring 850, 950 and at least one beater ring 870, 970. Drive ring 850, 950 may be independently, separately rotatably adjustable about drive shaft 840, 940 so as to fine tune drive ring 850, 950 and beater ring 870, 970 over a continuous range of adjustment angles. In addition, drive rings 850, 950 and beater rings 870, 970 may be adjustable without the need to disassemble assembly, including obviating a need to remove drive shaft 840, 940 from containment within a support ring 835, 935.

As with each of the pedal designs described above, parameters of pedals 10, 310 may be designed to avoid a "dead stop," thereby making pedals 10, 310 more ergonomically comfortable and less strenuous on the joints of a user. For example, springs 120, 420 may be compression springs. Moreover, springs 120, 420 may have a predetermined stiffness such that operation of pedals 10, 310 may not result in only partial compression of springs 120, 420 when foot boards 20, 320 are fully depressed. This partial compression may allow for additional force absorption by enabling foot board to travel slightly beyond its fully depressed position without generating an impact caused by total compression of spring 120, 420.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

We claim:

1. A universal joint comprising:

a spider comprising a unitary structure, said spider having a plurality of holes formed completely within said spider;

two pairs of trunnions, each pair of trunnions having an axis;

wherein each one of said trunnions has a part proximal to said spider and a distal part extending from said spider;

wherein each trunnion is inserted into a respective one of said plurality of holes in said spider;

a pair of yokes, each yoke having a shaft and a pair of bosses;

wherein said shafts of said yokes extend away from said spider in generally opposite directions, wherein each pair of bosses includes openings for receiving said distal parts of a corresponding pair of trunnions, wherein said spider has an inner surface forming an interior space, wherein said distal parts of said trunnions extend into said interior space, wherein said bosses receive said distal parts of said trunnions within said interior space; wherein said bosses extend within small tolerances of said inner surface; and wherein for each pair of trunnions, there is a spacing of from about ¾ inch to about 1½ inch between said proximal parts.

2. A universal joint according to claim 1, wherein said spider has two pairs of roller bearings, each pair of bearings having an axis, said axes of said roller bearings being generally coplanar, and wherein each one of said roller bearings receives said proximal part of a corresponding one of said trunnions.

3. A universal joint according to claim 2, wherein said proximal parts of said trunnions are sized larger than an interior diameter of said roller bearings to form an interference fit.

4. A universal joint according to claim 3, wherein said interference fit is between about $1/10{,}000$ inch and about $3/10{,}000$.

5. A universal joint according to claim 1, wherein, for each pair of trunnions, there is a gap between said distal parts.

6. A universal joint according to claim 1, wherein said spider is ring-shaped.

7. A linkage comprising:

a shaft having a pair of yokes, one at each end of said shaft, each of said yokes connecting into a universal joint, each universal joint having another yoke extending away therefrom;

wherein each yoke has a shaft and a pair of bosses;

wherein each universal joint has a spider comprising a unitary structure, said spider having a plurality of holes formed completely within said spider, and two pairs of trunnions, each pair of trunnions having an axis, each one of said trunnions having a part proximal to said spider and a distal part extending from said spider;

wherein each trunnion is inserted into a respective one of said plurality of holes in said spider;

wherein said shafts of said yokes extend away from said spider in generally opposite directions;

wherein each pair of bosses includes openings for receiving said distal parts of a corresponding pair of trunnions;

wherein said spider has an inner surface forming an interior space, wherein said distal parts of said trunnions extend into said interior space, wherein said bosses receive said distal parts of said trunnions within said interior space, wherein said bosses extend within small tolerances of said inner surface, and wherein for each pair of trunnions, there is a spacing of from about ¾ inch to about 1½ inch between said proximal parts.

8. A linkage according to claim 7, wherein said shaft of said linkage has an adjustable length.

9. A linkage according to claim 8 wherein said length of said shaft of said linkage is adjustable from about 9 inches to about 18 inches.

10. A linkage according to claim 7, wherein said shaft is telescoping.

11. A drum pedal assembly comprising:

a drum pedal having a base with a pedestal, a drive assembly supported by said pedestal, and a foot board operatively connected to said drive assembly; and a linkage comprising:

a shaft having a pair of yokes, one at each end, each yoke having a shaft and a pair of bosses, each of said yokes connecting into a universal joint;

wherein each universal joint has another yoke extending away therefrom, each yoke having a shaft and a pair of bosses, one of said yokes being operatively connected to said drive assembly and the other of said yokes being operatively connected to a support;

wherein each universal joint has a spider comprising a unitary structure, said spider having a plurality of holes formed completely within said spider, said universal joint further comprising two pairs of trunnions, each pair of trunnions having an axis, each one of said trunnions having a part proximal to said spider and a distal part extending from said spider;

wherein, for each universal joint, each trunnion is inserted into a respective one of said plurality of holes in said spider;

wherein, for each universal joint, said shafts of said yokes extend away from said spider in generally opposite directions, wherein, for each universal joint, each pair of bosses includes openings for receiving said distal parts of a corresponding pair of trunnions, wherein, for each universal joint, said spider has an inner surface forming an interior space, wherein said distal parts of said trunnions extend into said inner space, wherein said bosses receive said distal parts of said trunnions within said interior space, wherein said bosses extend within small tolerances of said inner surface, and wherein for each pair of trunnions, there is a spacing of from about ¾ inch to about 1½ inch between said proximal parts; and a beater operatively connected to an end of said linkage that is proximal to said support, wherein pressing said foot board of said pedal rotates said linkage and actuates said beater.

12. A drum pedal assembly according to claim 11, wherein said drum pedal is a first drum pedal and said support is a second drum pedal, said second drum pedal having a base with a pedestal, a drive assembly supported by said pedestal, a foot board operatively connected to said drive assembly, and a second beater operatively connected to said drive assembly so that pressing said foot board of said second drum pedal actuates said second beater in generally the same direction as said beater actuated by said first pedal.

13. A drum pedal assembly according to claim 12, wherein at least one of said drive assemblies of said first pedal and said second pedal comprises a journaled drive shaft, a rotatably adjustable drive ring mounted on said drive shaft having an arm, and a rotatably adjustable beater ring mounted on said drive shaft.

14. A drum pedal assembly according to claim 12, wherein at least one of said drive assemblies of said first pedal and said second pedal comprises a journaled drive shaft, a rotatable bearing mounted off center of said drive shaft, a spring, and a biasing arm pivotally mounted on said pedestal, wherein said bearing and said spring cooperate to bias said arm toward a predetermined rest position.

15. A drum pedal assembly according to claim 12, wherein said linkage is releasably attached to said first pedal and said second pedal.

16. A drum pedal assembly according to claim 11 wherein said length of said shaft of said linkage is adjustable from about 9 inches to about 18 inches.

17. A linkage according to claim 11, wherein said shaft of said linkage is telescoping.

18. A drum pedal assembly according to claim 11, wherein each of said universal joints further comprises:

two pairs of roller bearings, each pair of roller bearings having an axis, said axes being generally coplanar;

wherein each one of said roller bearings receives a proximal part of one of said trunnions, and wherein a distal part of each one of said trunnions extends from said spider, each one of said trunnions being generally coplanar.

19. A drum pedal assembly according to claim 18, wherein said proximal parts of said trunnions interfere with said roller bearings to generate a generally compressive force on said trunnions while allowing said trunnions to pivot within said roller bearings.

* * * * *

UNITED STATES PATENT AND TRADEMARK OFFICE

CERTIFICATE OF CORRECTION

PATENT NO. : 7,633,000 B2
APPLICATION NO. : 11/850112
DATED : December 15, 2009
INVENTOR(S) : Michael Dorfman, George Szwaya and Robert Szwaya It is certified that error appears in the above-identified patent and that said Letters Patent is hereby corrected as shown below:

The word "distal" should be stricken from column 16, line 18 so that the first sentence of that paragraph reads:

"For each pair of trunnions 1204, 1206, the spacing between proximal parts 1228, 1230 of each trunnion 1204, 1206 may vary depending on the intended use of the universal joint 1200."

Signed and Sealed this

Ninth Day of February, 2010

David J. Kappos

David J. Kappos
*Director of the United States Patent and Trademark Office*